US006443262B1

(12) United States Patent
Karanouh

(10) Patent No.: US 6,443,262 B1
(45) Date of Patent: Sep. 3, 2002

(54) TUBULAR FRAME SCAFFOLDING

(75) Inventor: Rached N. Karanouh, Strongsville, OH (US)

(73) Assignee: Waco International Corporation, Cleveland, OH (US)

( * ) Notice: Subject to any disclaimer, the term of this patent is extended or adjusted under 35 U.S.C. 154(b) by 0 days.

(21) Appl. No.: 09/475,906

(22) Filed: Dec. 30, 1999

(51) Int. Cl.[7] ..... E04G 7/00

(52) U.S. Cl. ..... 182/178.1; 182/152.1; 182/170.5; 182/179.1

(58) Field of Search ..... 182/178.1, 178.5, 182/82, 179.1, 152.1; 403/349; 248/188.4, 188.2

(56) References Cited

U.S. PATENT DOCUMENTS

| | | | | | |
|---|---|---|---|---|---|
| 918,039 | A | * | 4/1909 | Grundmann | 182/178.1 X |
| 2,316,952 | A | | 4/1943 | Halferty | 304/4 |
| 2,438,173 | A | | 3/1948 | Johnson et al. | 304/2 |
| 2,445,453 | A | | 7/1948 | Pennington | 304/2 |
| 2,872,251 | A | | 2/1959 | Crosby | 304/2 |
| 2,963,257 | A | * | 12/1960 | Ferguson | 248/354 |
| 2,982,379 | A | * | 5/1961 | Fisher | 182/82 X |
| 3,473,627 | A | | 10/1969 | Repka | 182/16 |
| 3,564,802 | A | * | 2/1971 | Dreyfus | 182/82 X |
| 3,647,080 | A | * | 3/1972 | Denny | 211/176 |
| 3,807,120 | A | * | 4/1974 | Viandon | 182/178.5 X |
| 3,817,347 | A | | 6/1974 | Spencer | 182/115 |
| 3,850,264 | A | * | 11/1974 | Salinas | 182/178.5 X |
| 3,885,648 | A | * | 5/1975 | Beziat | 182/178 |
| 3,901,609 | A | * | 8/1975 | Gostling | 403/49 |
| 3,902,817 | A | * | 9/1975 | Meir | 403/188 |
| 4,301,627 | A | | 11/1981 | Wilson | 52/6 |
| 4,430,019 | A | * | 2/1984 | D'Alessio | 403/409 |
| 4,480,819 | A | | 11/1984 | Lopez | 256/1 |
| 4,598,794 | A | | 7/1986 | Anderson | 182/113 |
| 4,619,549 | A | * | 10/1986 | Gilbreth | 403/349 |
| 4,624,342 | A | | 11/1986 | Anderson | 182/223 |
| 4,782,914 | A | * | 11/1988 | Nail | 182/179.1 X |
| 4,787,475 | A | | 11/1988 | Arteau et al. | 182/82 |
| 5,135,077 | A | * | 8/1992 | Shalders | 182/82 |
| 5,746,289 | A | | 5/1998 | Williams | 182/129 |
| 5,810,114 | A | | 9/1998 | White | 182/178.5 |
| 5,829,549 | A | | 11/1998 | Flynn | 182/82 |
| 5,862,880 | A | | 1/1999 | Nelson et al. | 182/45 |
| 5,901,810 | A | * | 5/1999 | Krause | 182/178.5 |

* cited by examiner

*Primary Examiner*—Bruce A. Lev
(74) *Attorney, Agent, or Firm*—Todd Mattingly; Haynes & Boone, LLP

(57) ABSTRACT

A tubular frame scaffolding system including base pads, vertical trusses, work platforms, access ladders, diagonal support braces, horizontal guard rails, intermediate guard rail panels, top guard rail panels, top guard rail posts, and toeboards. The guard rails and the toeboards act as safety devices to protect against accidental falls during the use of the tubular frame scaffolding system.

4 Claims, 29 Drawing Sheets

TUBULAR FRAME SCAFFOLDING

BACKGROUND OF THE INVENTION

This invention relates generally to a scaffolding system and more particularly to a scaffolding system with improved safety features designed for easy assembly and disassembly.

Scaffolding systems are commonly used to perform work tasks at elevations beyond reach of workers, or in other hard-to-reach places. The existing scaffolding systems suffer from a number of limitations. The existing scaffolding systems often include a large number of components. The components of the existing scaffolding systems are often difficult to assemble, making the assembly of the existing scaffolding systems a tedious, time-consuming endeavor. In addition, many of the existing scaffolding systems lack adequate safety features, resulting in a hazardous working environment for the workers who use the scaffolding systems.

The present invention is directed to overcoming one or more of the limitations of the existing scaffolding systems.

SUMMARY OF THE INVENTION

According to one aspect of the present invention, a tubular scaffolding system is provided that includes a plurality of base pads for providing a foundation for the scaffolding system, a plurality of tubular vertical trusses for forming a skeleton of the scaffolding system, one or more work platforms coupled to the vertical trusses, one or more access ladders coupled to the work platforms, one or more horizontal guard rails coupled to the vertical trusses, and one or more diagonal support braces coupled to the vertical trusses.

According to another aspect of the present invention, a platform system for detachable affixation on a tubular frame scaffolding system is provided that includes a work platform, an access ladder coupled to the work platform, one or more hooks for coupling a top end of the access ladder to the work platform, and a latching device for supporting a bottom end of the access ladder beneath the work platform.

According to another aspect of the present invention, an intermediate guard rail panel for detachable affixation on a tubular frame scaffolding system is provided that includes a plurality of vertical support bars and one or more horizontal support bars fixedly attached to the vertical support posts.

According to another aspect of the present invention, a top guard rail post for use on a tubular frame scaffolding system is provided that includes a fixed vertical support post, a horizontal post for supporting a work platform coupled to the fixed vertical support post, and a hinge for coupling the fixed vertical support post to the horizontal support post.

According to another aspect of the present invention, a method of assembling a scaffolding system is provided that includes placing a plurality of base pads on a ground surface, coupling a plurality of tubular vertical trusses to the base pads to form a skeleton for the scaffolding system, attaching one or more platform systems to the vertical trusses, coupling one or more horizontal guard rails and one or more diagonal support braces to the vertical trusses, and coupling one or more top guard rail posts to the tubular vertical trusses on top of the scaffolding system.

According to another aspect of the present invention, a method of affixing a vertical truss to a tubular frame scaffolding system is provided that includes mating the vertical truss to the tubular frame scaffolding system and fastening the vertical truss to the tubular frame scaffolding system with a toggle pin.

According to another aspect of the present invention, a method of affixing a top guard rail panel to a tubular frame scaffolding system is provided that includes mating the top guard rail panel to the tubular frame scaffolding system and fastening the top guard rail panel to the tubular frame scaffolding system with a toggle pin.

According to another aspect of the present invention, a method of affixing a top guard rail post to a tubular frame scaffolding system is provided that includes mating the top guard rail post to the tubular frame scaffolding system and fastening the top guard rail post to the tubular frame scaffolding system with a toggle pin.

According to another aspect of the present invention, a method of affixing an intermediate guard rail panel to a tubular frame scaffolding system is provided that includes mating the intermediate guard rail panel to the tubular frame scaffolding system.

BRIEF DESCRIPTION OF THE DRAWINGS

FIG. 8*l* illustrates an embodiment of the top guard rail post of FIG. 6 coupled to the scaffolding system of FIG. 8*k*.

DETAIL DESCRIPTION OF THE PREFERRED EMBODIMENT

A preferred embodiment of a tubular frame scaffolding system is provided. The system preferably includes a plurality of trusses, a plurality of crossbraces, a plurality of work platforms and a plurality of safety accessories. The trusses are coupled together by a design feature and a plurality of toggle pins.

Figure 1:
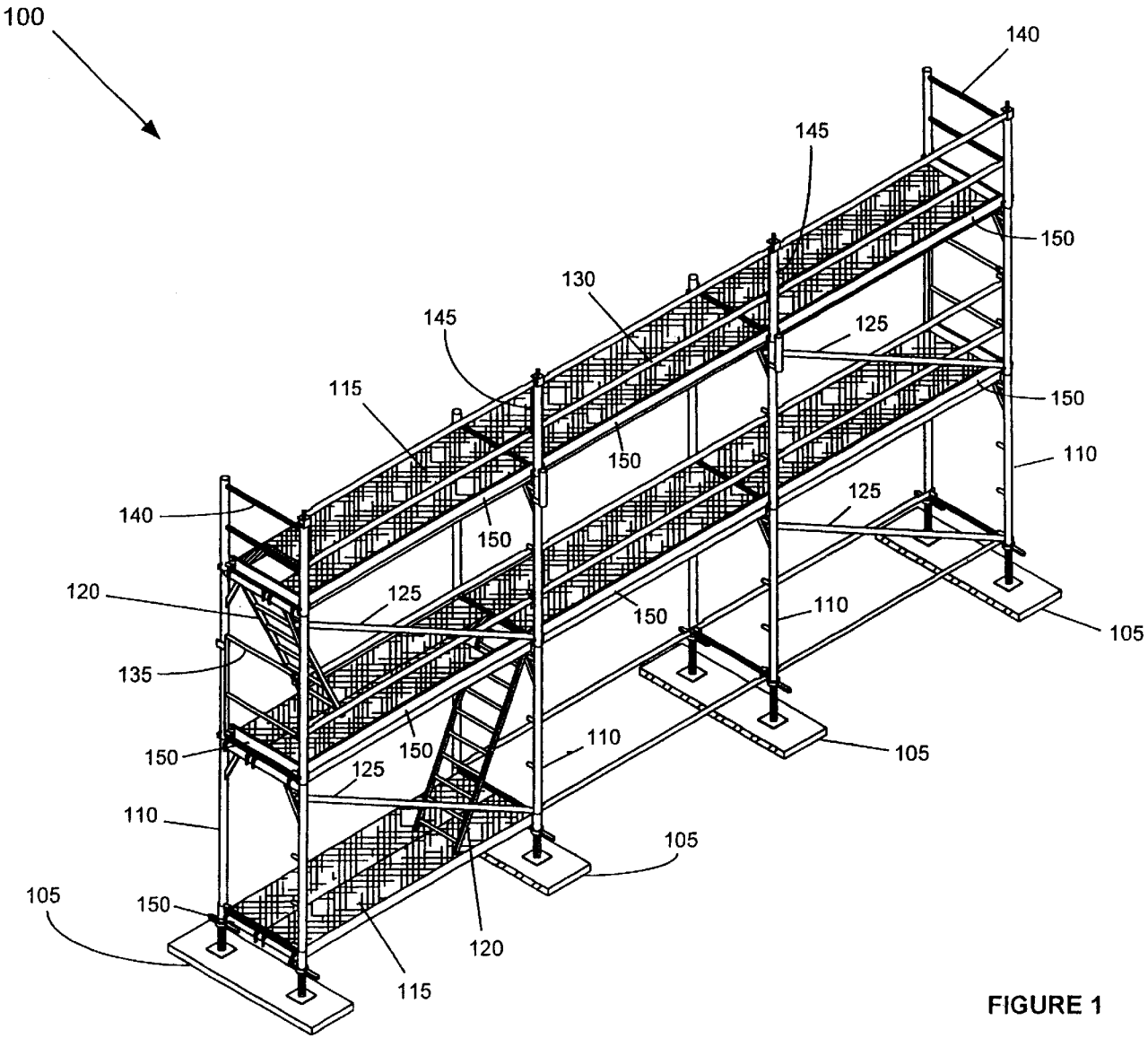
FIG. 1 illustrates an embodiment of a tubular frame scaffolding system.

In a preferred embodiment, as illustrated in FIG. 1, the tubular frame scaffolding system 100 includes a plurality of base pads 105, a plurality of vertical trusses 110, one or more work platforms 115, one or more access ladders 120, one or more diagonal support braces 125, one or more horizontal guard rails 130, one or more intermediate guard rail panels 135, one or more top guard rail panels 140, one or more top guard rail posts 145, and one or more toeboards 150.

Figure 2:
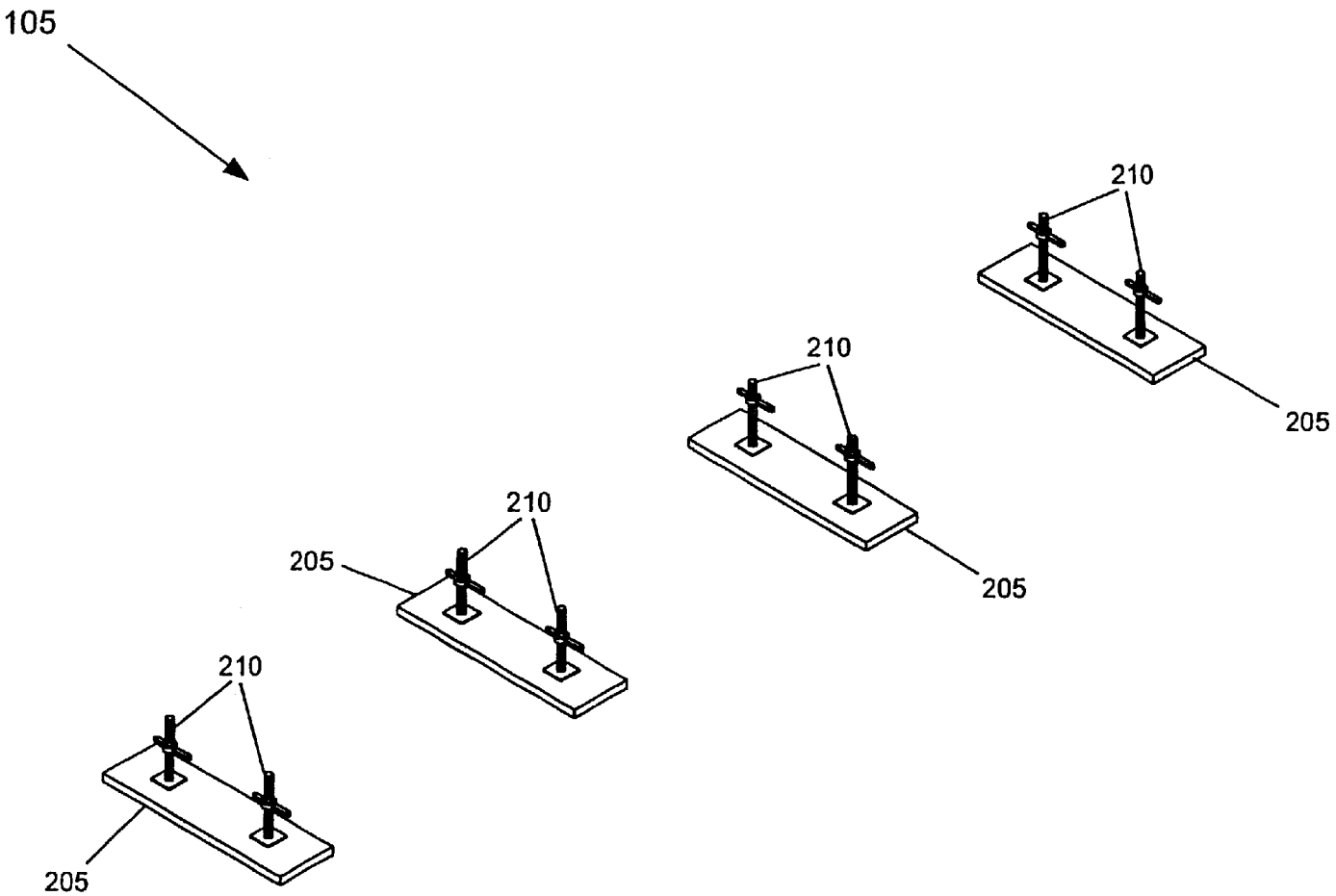
FIG. 2 illustrates an embodiment of base pads included within the scaffolding system of FIG. 1.

In a preferred embodiment, as illustrated in FIG. 2, the base pads 105 include a base support 205 and one or more threaded screw connectors 210 for coupling the base pads 105 to the tubular frame scaffolding system 100.

The base supports 205 may include any number of base supports suitable for providing a foundation for the tubular frame scaffolding system 100. In a preferred embodiment, the base supports 205 are fabricated from lumber.

The threaded screw connectors 210 preferably couple the base supports 205 to the tubular frame scaffolding system 100. In a preferred embodiment, the threaded screw connectors 210 couple the base pads 105 to the vertical trusses 110 within the tubular frame scaffolding system 100. In another preferred embodiment, the threaded screw connectors 210 couple the base pads 105 to the work platforms 115 within the tubular frame scaffolding system 100. The threaded screw connectors 210 may include any number of conventional commercially available screw connectors suitable for coupling the base pads 105 to the tubular frame scaffolding system 100. In a preferred embodiment, the threaded screw connectors 210 are 1⅜ inch threaded steel round bars.

Figure 3A:
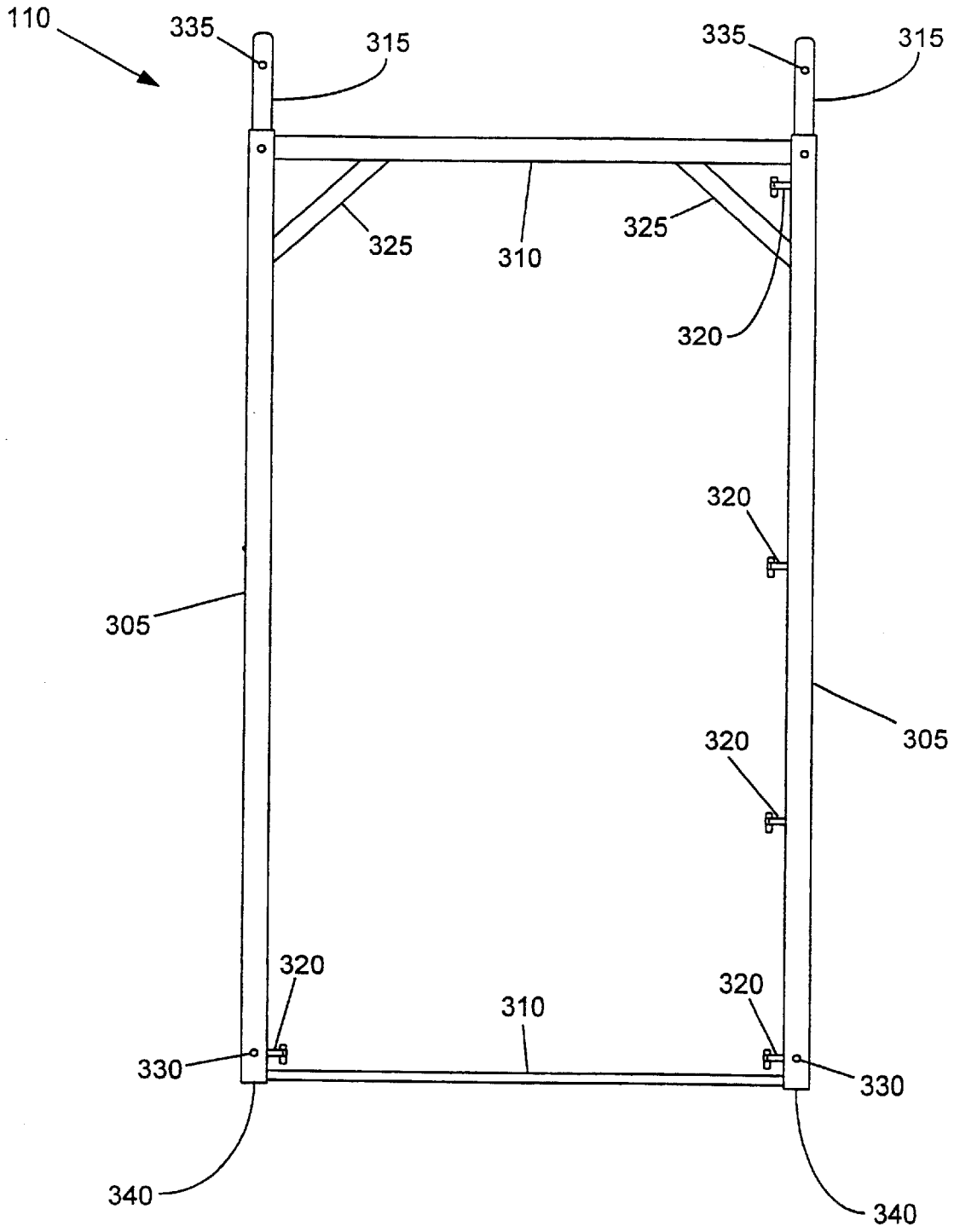
FIG. 3*a* illustrates an embodiment of a vertical truss included within the scaffolding system of FIG. 1.
Figure 3B:
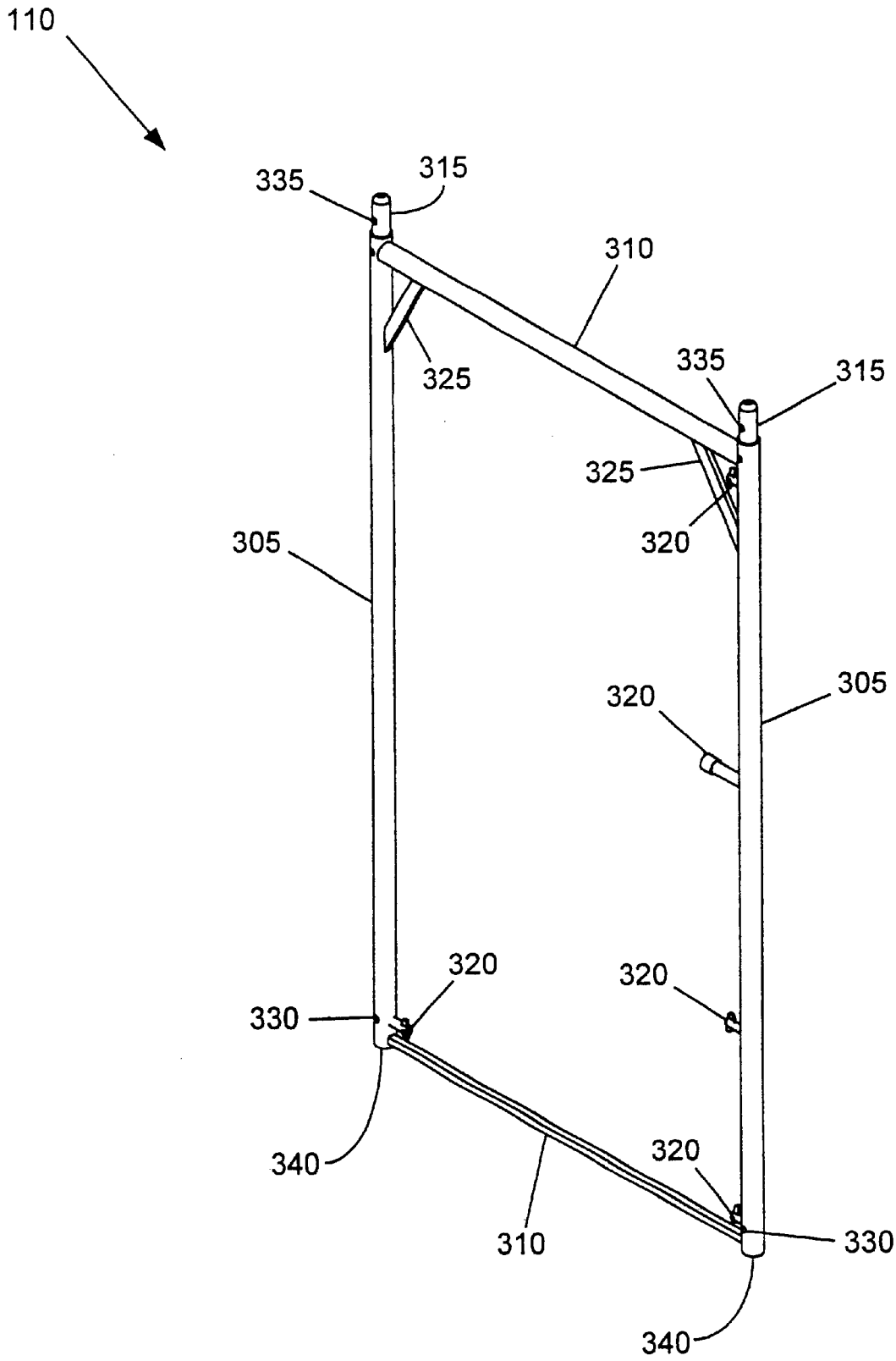
FIG. 3*b* is a perspective view of the vertical truss of FIG. 3*a*.
Figure 3C:
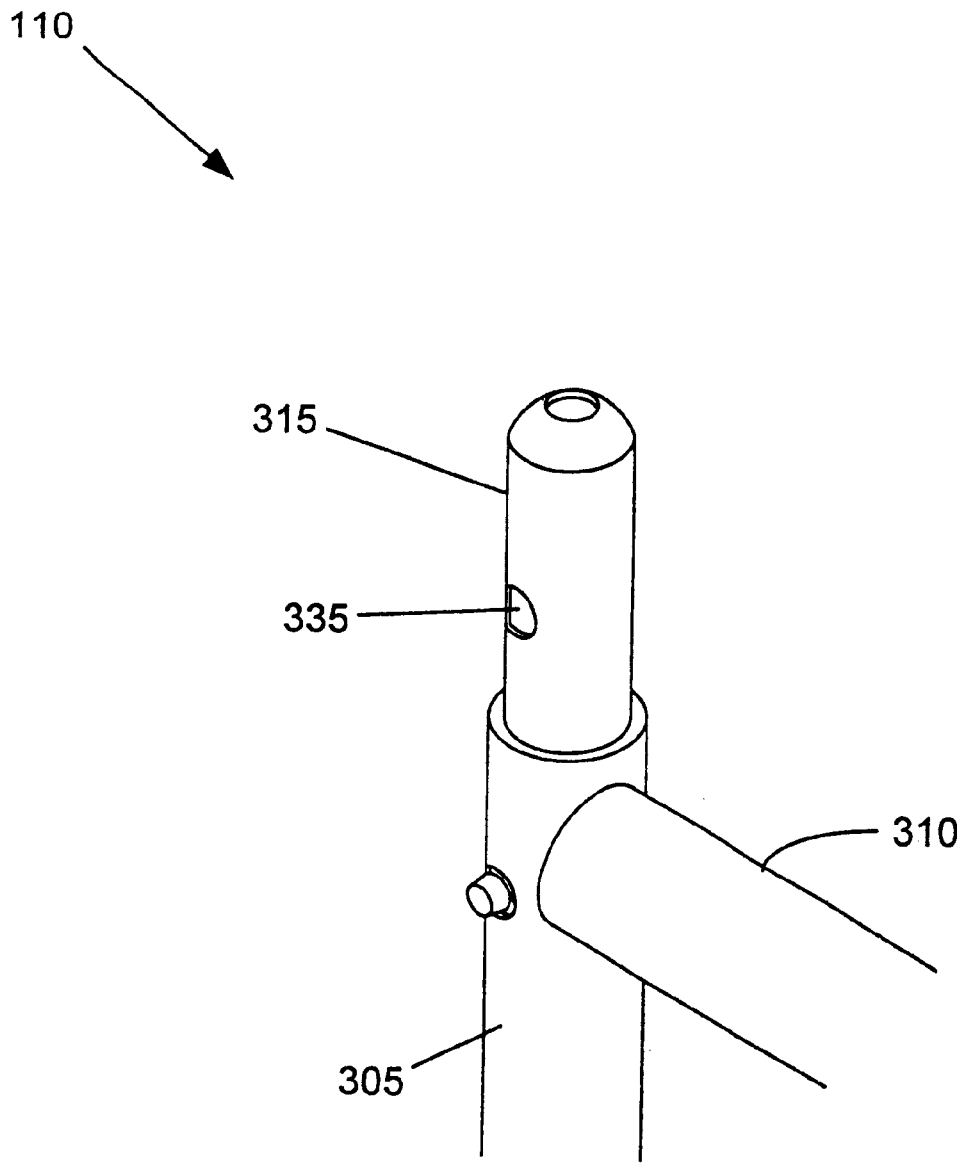
FIG. 3*c* illustrates an embodiment of a vertical extension included within the vertical truss of FIG. 3*a*.

The vertical trusses 110 preferably provide the skeletal support for the tubular frame scaffolding system 100. In a preferred embodiment, as illustrated in FIGS. 3*a*, 3*b*, and 3*c*, the vertical trusses 110 include a plurality of vertical support bars 305, a plurality of horizontal support bars 310 coupled to the vertical support bars 305, one or more vertical extensions 315 located on top of the vertical support bars 305, one or more coupling devices 320, one or more diagonal support bars 325, one or more bottom fastening holes 330, one or more top fastening holes 335, and one or more bottom mating conduits 340. In a preferred embodiment, the vertical trusses 110 are fabricated from 1⅝ inch steel tubing.

Figure 4A:
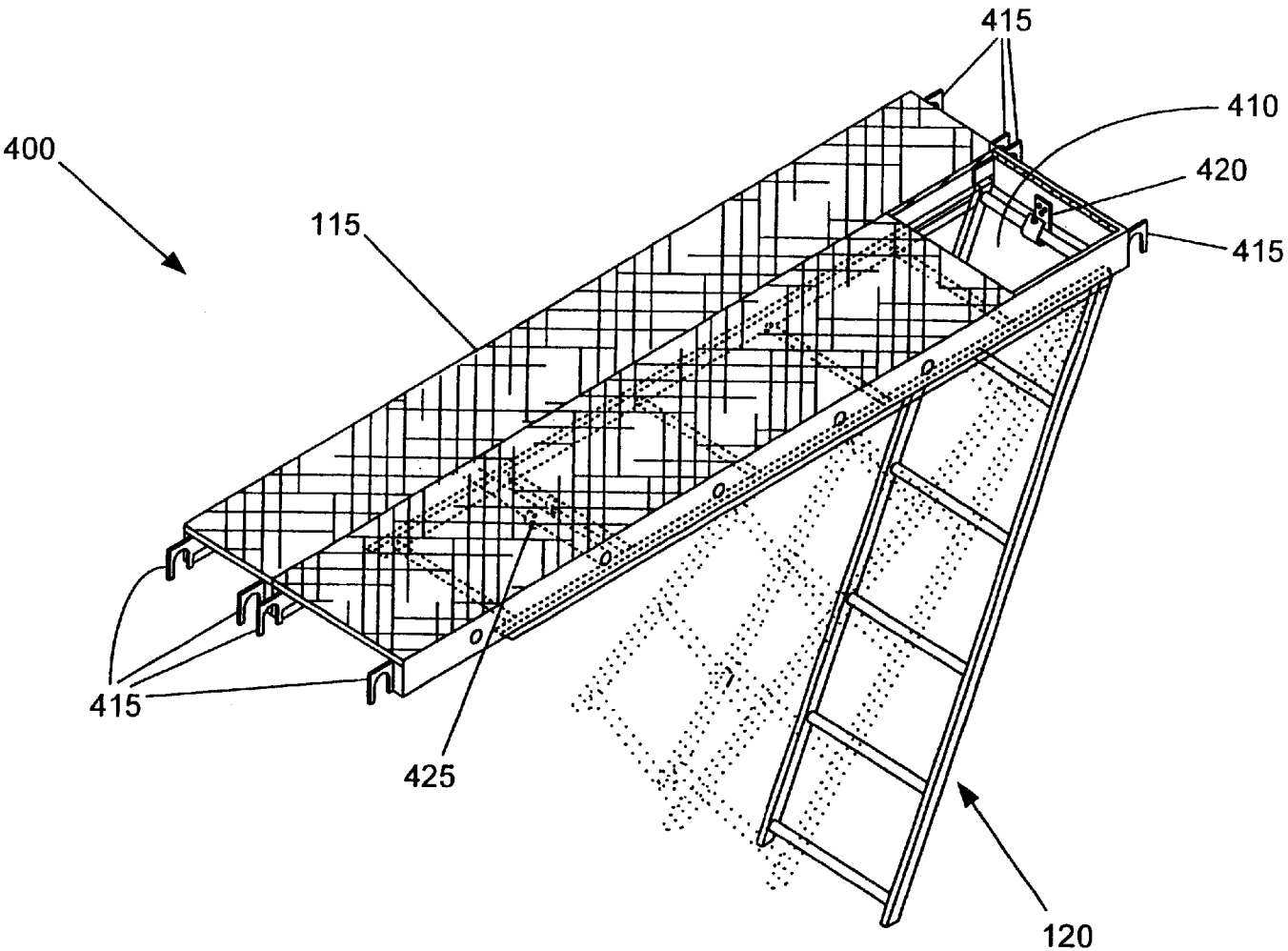
FIG. 4*a* illustrates a perspective view of an embodiment of a platform system included within the scaffolding system of FIG. 1.
Figure 4B:
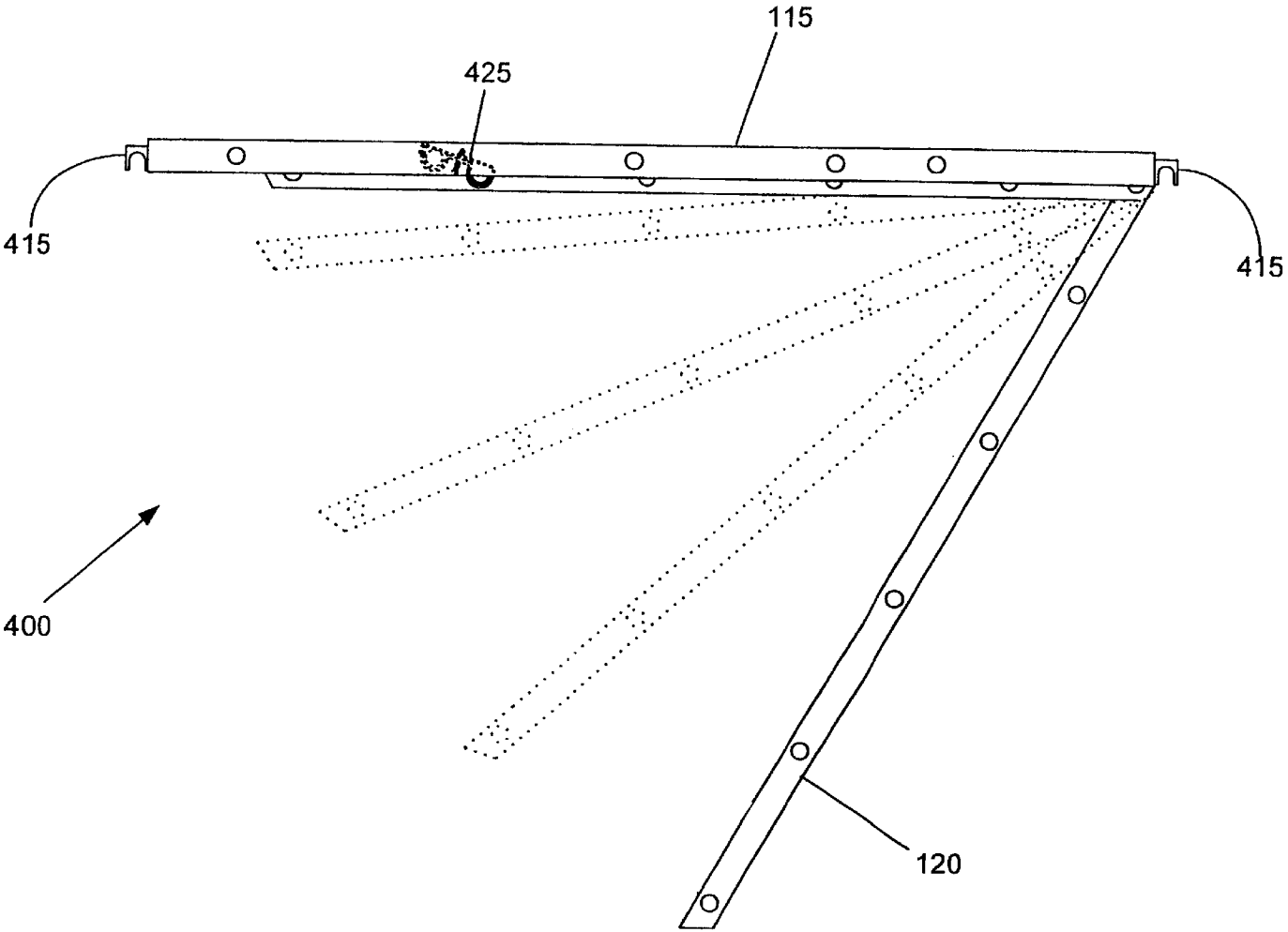
FIG. 4*b* illustrates an embodiment of the platform system of FIG. 4*a*.

Referring to FIGS. 4*a*, 4*b*, 4*c*, and 4*d*, a preferred embodiment of a platform system 400 for use in the tubular frame scaffolding system 100 will now be described. In a preferred embodiment, as illustrated in FIGS. 4*a* and 4*b*, the platform system 400 includes the work platform 115, the access ladder 120, an access passage 410, a plurality of hooks 415 for coupling the platform system 400 to the tubular frame scaffolding system 100, one or more hooks 420 for coupling the access ladder 120 to the work platform 115, and a latching device 425.

The work platform 115 is preferably used to provide a platform on which to stand within the tubular frame scaffolding system 100. The work platform 115 may include any number of conventional commercially available platforms suitable for use as a platform within the tubular frame scaffolding system 100. In a preferred embodiment, the work platform 115 is a platform fabricated from plywood. In another preferred embodiment, the work platform 115 is a platform fabricated from aluminum. The work platform 115 may include an access passage 410 where the access ladder 120 is coupled to the work platform 115.

The access ladder 120 is preferably coupled to the work platform 115 and connects one level of work platforms 115 to another level of work platforms 115. The access ladder 120 is preferably a ladder fabricated from aluminum.

Figure 4C:
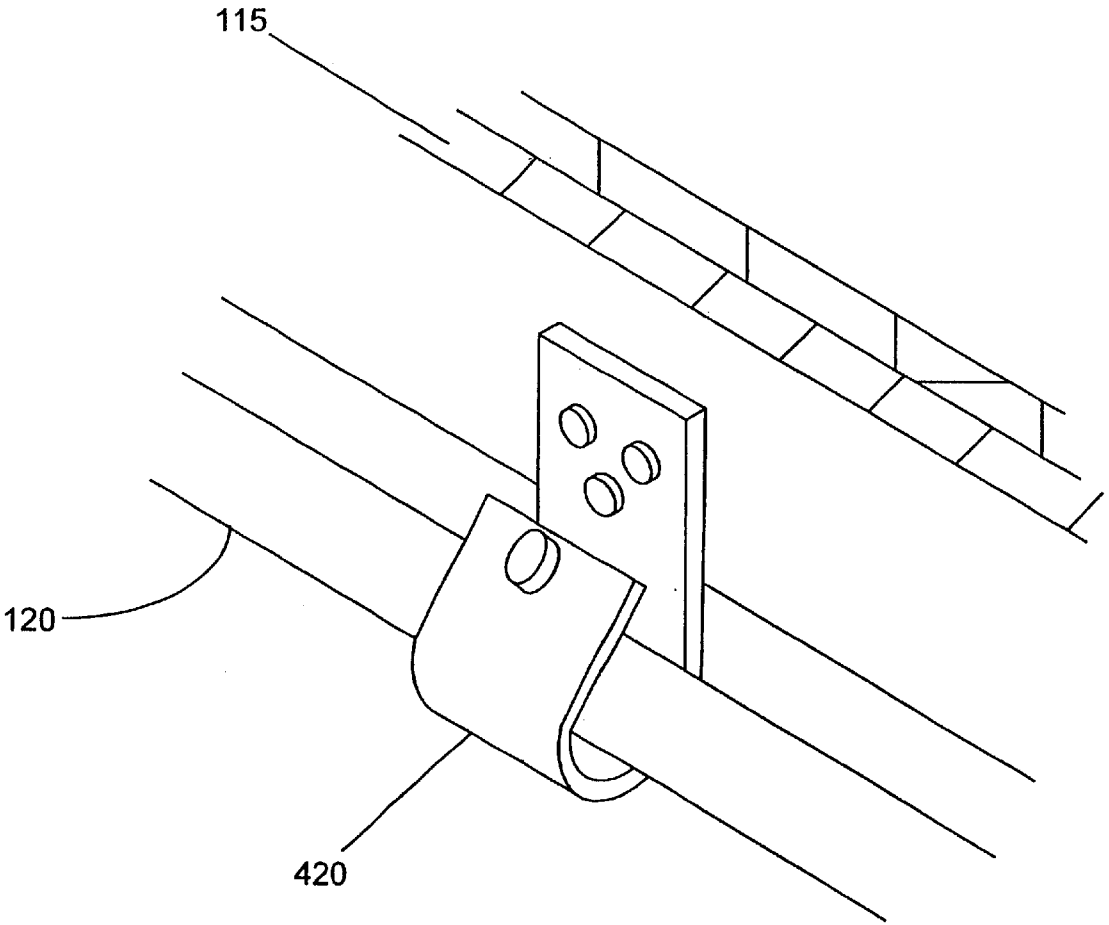
FIG. 4*c* illustrates an embodiment of a hook included within the platform system of FIG. 4*a*.

In a preferred embodiment, as illustrated in FIG. 4*c*, the hook 420 preferably couples the access ladder 120 to the work platform 115. The hook 420 may include any number of conventional commercially available hooks suitable for coupling the access ladder 120 to the work platform 115.

Figure 4D:
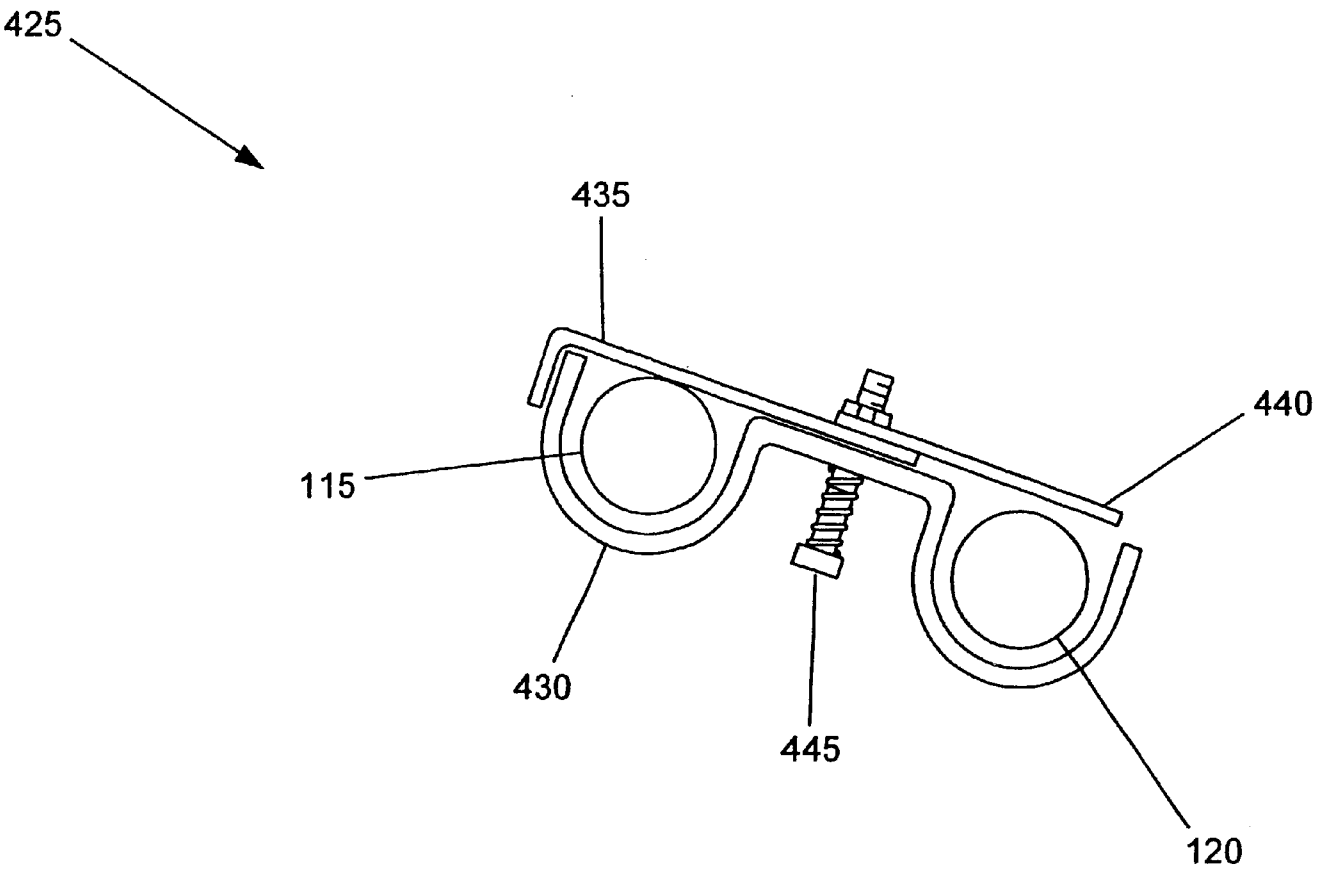
FIG. 4*d* illustrates an embodiment of a latching device included within the platform system of FIG. 4*a*.

The latching device 425 is preferably coupled to a bottom side of the work platform 115 and is used to latch a bottom of the access ladder 120 to the work platform 115. The latching device 425 may include any number of conventional commercially available latching devices suitable for latching the bottom of the access ladder 120 to the work platform 115. In a preferred embodiment, as illustrated in FIG. 4*d*, the latching device 425 includes a latching body 430, a first latch cover 435, and a second latch cover 440. The latching device 425 is preferably coupled to the work platform 425 by a screw 445.

The hooks 415 preferably couple the platform system 400 to the tubular frame scaffolding system 100. In a preferred embodiment, the hooks 415 couple the platform system 400 to the tubular frame scaffolding system 100 by latching onto the horizontal support bars 310 in the vertical trusses 110. The hooks 415 may include any number of conventional commercially available hooks suitable for coupling the platform system 400 to the tubular frame scaffolding system 100. In a preferred embodiment, the hooks 415 are fabricated from aluminum.

The diagonal support braces 125 and the horizontal guard rails 130 are preferably coupled to the vertical trusses 110 and the top guard rail posts 145. In a preferred embodiment, the diagonal support braces 125 and the horizontal guard rails 130 are used as a safety device to protect against falls during the use of the tubular frame scaffolding system 100.

The diagonal support braces 125 and the horizontal guard rails 130 are preferably positioned on only one side of the tubular frame scaffolding system 100, leaving the other side unobstructed for the users of the tubular frame scaffolding system 100. The diagonal support braces 125 and the horizontal guard rails 130 may be fabricated from any number of materials suitable for creating safety guard rails. In a preferred embodiment, the diagonal support braces 125 and the horizontal guard rails 130 are fabricated from 1¼ inch galvanized tubing.

Figure 5:
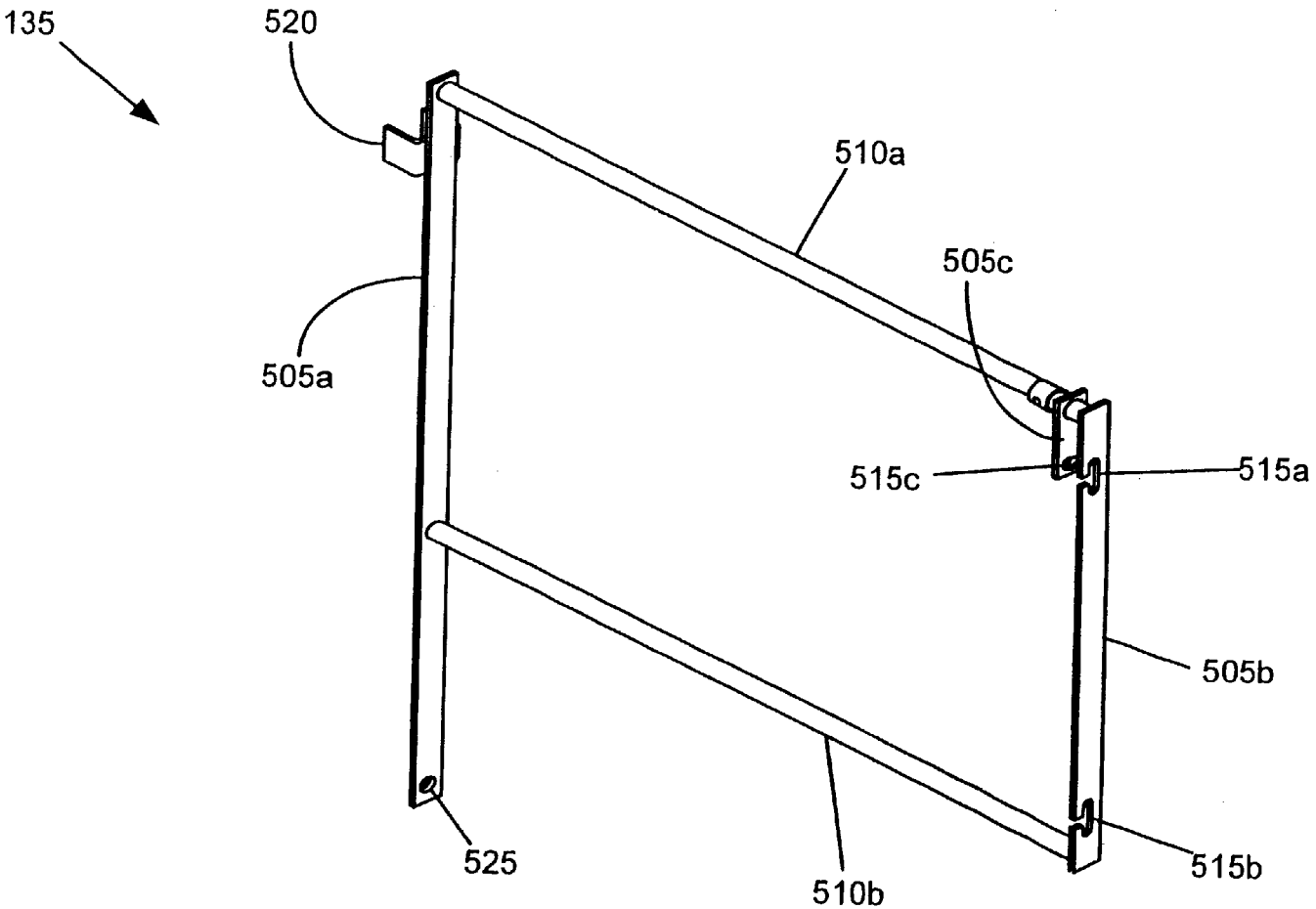
FIG. 5 illustrates an embodiment of an intermediate guard rail panel included within the scaffolding system of FIG. 1.

The intermediate guard rail panels 135 are preferably coupled to the tubular frame scaffolding system 100. In a preferred embodiment, the intermediate guard rail panels 135 are coupled to the vertical trusses 110 within the tubular frame scaffolding system 100. The intermediate guard rail panels 135 are preferably used as safety devices to protect against accidental falls during the use of the tubular frame system 100. The intermediate guard rail panels 135 are preferably positioned within the vertical trusses 110 on the ends of the tubular frame scaffolding system 100. In a preferred embodiment, as illustrated in FIG. 5, the intermediate guard rail panels 135 include vertical support bars 505*a*, 505*b*, and 505*c*, horizontal support bars 510*a* and 510*b*, keying slots 515*a*, 515*b*, and 515*c* positioned within the vertical support bars 505*a*, 505*b*, and 505*c*, respectively, a brace 520, and an opening 525 provided in the lower portion of the vertical support bar 505*a*. The length of the vertical support bar 505*c* is less than the length of the vertical support bar 505*b*, the keying slots 515*a* and 515*b* are substantially T-shaped, and the keying slot 515*c* is substantially horizontal.

In a preferred embodiment, the vertical support bars 505*a*, 505*b*, and 505*c* and the horizontal support bars 510*a* and 510*b* are coupled to form the structure of the intermediate guard rail panels 135. The vertical support bars 505*a*, 505*b*, and 505*c* and the horizontal support bars 510*a* and 510*b* may be fabricated from any number of materials suitable for creating the structure of the intermediate guard rail panels 135. In a preferred embodiment, the vertical support bars 505*a*, 505*b*, and 505*c* and the horizontal support bars 510*a* and 510*b* are fabricated from steel tubing.

In a preferred embodiment, the keying slots 515*a*, 515*b*, and 515*c* are used to align the intermediate guard rail panels 135 within the tubular frame scaffolding system 100. The keying slots 515*a*, 515*b*, and 515*c* are preferably adapted to mate with the coupling devices 320 in the vertical trusses 110. The keying slot 515*c* is substantially positioned in opposition of the keying slot 515*a*.

In a preferred embodiment, the brace 520 is used to position the intermediate guard rail panels 135 within the tubular frame scaffolding system 100. The brace 520 is preferably adapted to mate with the vertical support bars 305 of the vertical trusses 110. In a preferred embodiment, the brace 520 is fabricated from steel flat stock. In a preferred embodiment, the opening 525 is used to align the intermediate guard rail panels 135 within the tubular frame scaffolding system 100. The opening 525 is preferably adapted to mate with the coupling devices 320 in the vertical trusses 110.

Figure 6:
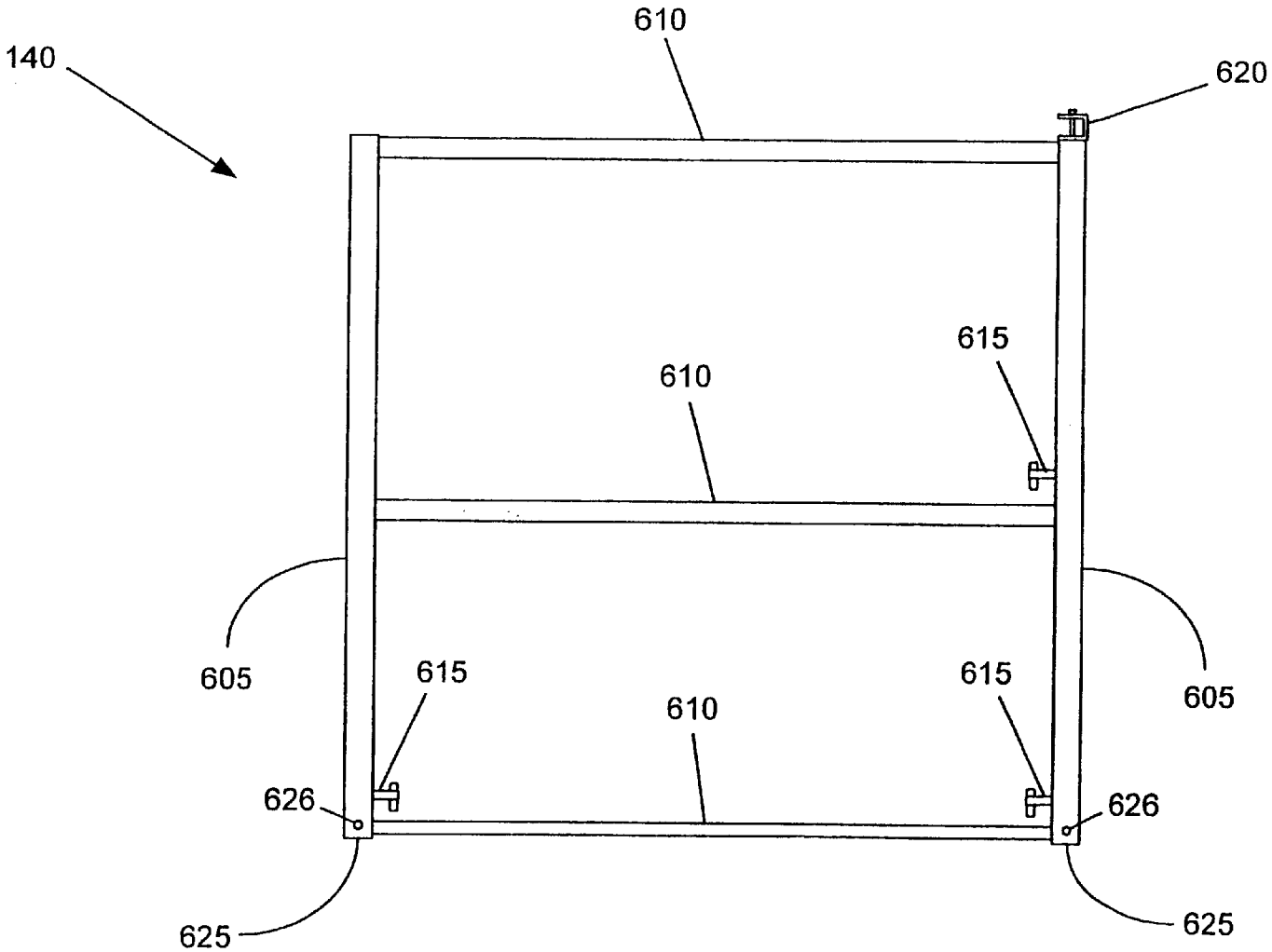
FIG. 6 illustrates an embodiment of a top guard rail panel included within the scaffolding system of FIG. 1.

The top guard rail panels 140 are preferably coupled to the vertical trusses 110 and the horizontal guard rails 130. The top guard rail panels 140 are preferably used as safety devices to protect against falls during the use of the tubular frame scaffolding system 100. In a preferred embodiment, as illustrated in FIG. 6, the top guard rail panels 140 include vertical support bars 605, horizontal support bars 610, keying members 615, a guard rail holder 620, mating conduits 625 positioned within the vertical support bars 605, and fastening holes 626.

In a preferred embodiment, the vertical support bars 605 and the horizontal support bars 610 are coupled to form the structure of the top guard rail panels 140. The vertical support bars 605 and the horizontal support bars 610 may be fabricated from any number of materials suitable for creating the top guard rail panels 140. In a preferred embodiment, the vertical support bars 605 and the horizontal support bars 610 are fabricated from ¾ inch steel tubing.

The keying members 615 are preferably used to align the top guard rail panels 140 within the tubular frame scaffolding system 100. The keying members 615 are preferably positioned on the vertical support bars 605, and are adapted to mate with the horizontal guard rails 130 and the toeboards 150.

The guard rail holders 620 are preferably located on top of the vertical support bars 605 and are used to support the horizontal guard rails 130.

The mating conduits 625 are preferably located within a bottom portion of the vertical support bars 605 and are used to mate the top guard rail panels 140 with the tubular frame scaffolding system 100. In a preferred embodiment, the mating conduits 625 are adapted to mate with the vertical extensions 315 on the vertical trusses 110.

The fastening holes 626 are preferably located within the mating conduits 625 and are used to fasten the top guard rail panels 140 to the tubular frame scaffolding system 100. In a preferred embodiment, the fastening holes 626 are adapted to align with the top fastening holes 335 in the vertical trusses 110.

Figure 7A:
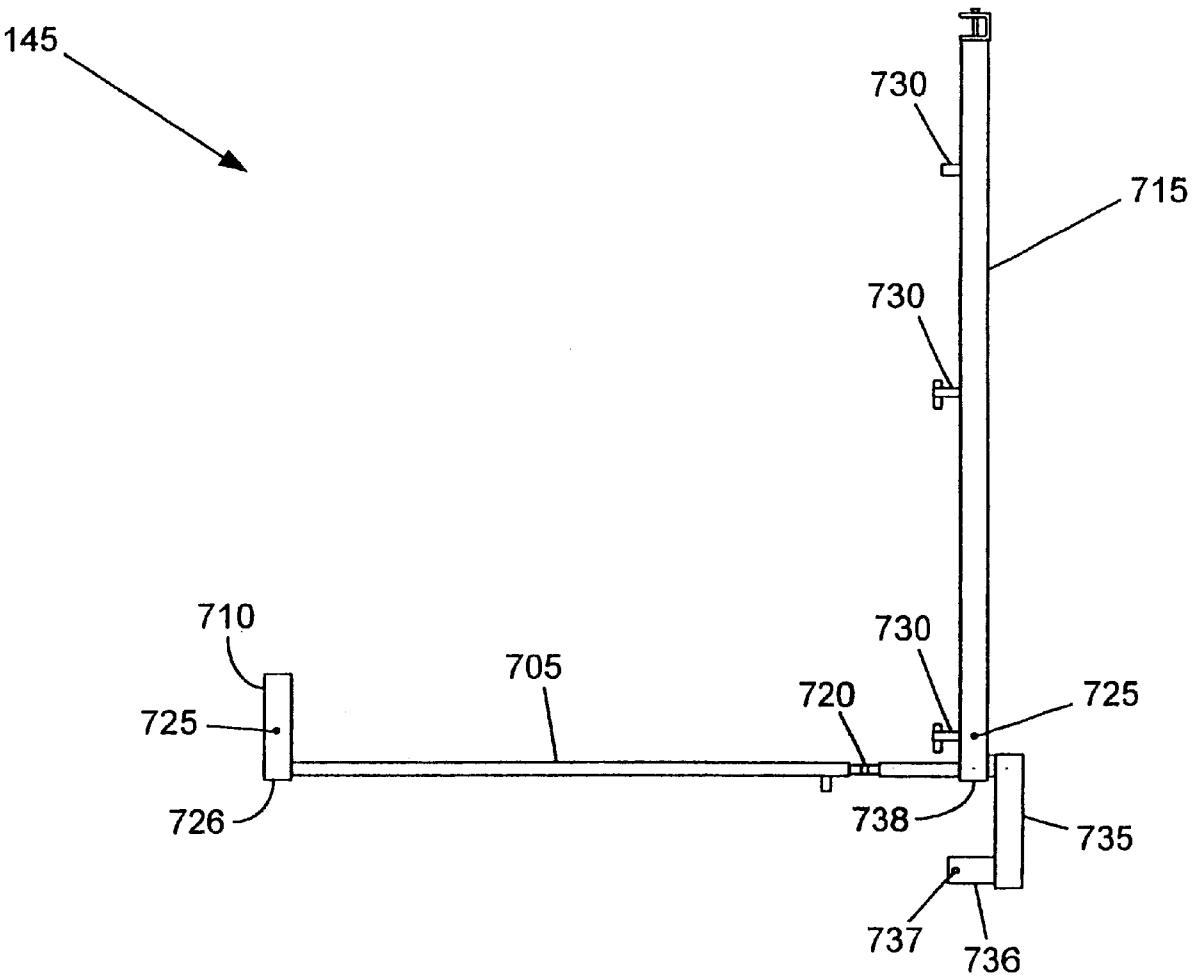
FIG. 7*a* illustrates an embodiment of a top guard rail post included within the scaffolding system of FIG. 1.

The top guard rail posts 145 are preferably coupled to the vertical trusses 110, the work platforms 115, and the horizontal guard rails 130 to provide a safety rail on a top level of the tubular frame scaffolding system 100. In a preferred embodiment, as illustrated in FIG. 7*a*, the top guard rail post 145 includes a horizontal support bar 705, a cap 710 coupled to the horizontal support bar 705, a vertical support bar 715, a hinge 720 for coupling the vertical support bar 715 to the horizontal support bar 705, fastening holes 725, keying members 730, an outrigger 735, a brace 736, a fastening hole 737 for the brace 736, and mating conduits 726, 738.

In a preferred embodiment, the horizontal support bar 705 and the vertical support bar 715 are coupled to form the frame of the top guard rail post 145. The vertical support bar 715 and the horizontal support bar 705 may be fabricated from any material suitable for forming a support bar. In a preferred embodiment, the vertical support bar 715 and the horizontal support bar 705 are fabricated from steel. In a preferred embodiment, the vertical support bar 715 includes a mating conduit 738 that is adapted to mate with the vertical extensions 315 on the vertical trusses 110.

The hinge 720 preferably couples the horizontal support bar 705 to the vertical support bar 715. The hinge 720 preferably allows the horizontal support bar 705 to rotate about the hinge 720. The hinge 720 may include any number of conventional commercially available hinges suitable for use in the top guard rail post 145.

The cap 710 is preferably positioned on the horizontal support bar 705 and is used to align the top guard rail post 145 within the tubular frame scaffolding system 100. In a preferred embodiment, the cap 710 includes a mating conduit 726. The mating conduit 726 is preferably adapted to mate with the vertical extensions 315 on the vertical trusses 110.

In a preferred embodiment, the fastening holes 725 are positioned within the vertical support bar 715 and the cap 710 and are adapted to fasten the top guard rail post 145 within the tubular frame scaffolding system 100. In a preferred embodiment, the fastening holes 725 are adapted to align with the top fastening holes 335 in the vertical trusses 110.

The keying members 730 are preferably positioned on the vertical support bar 715 and are adapted to mate with the horizontal guard rails 130 or the toeboards 150.

The outrigger 735 and the brace 736 are preferably used to align the top guard rail post 145 within the tubular frame scaffolding system 100. In a preferred embodiment, the brace 736 mates with the vertical support bars 305 in the vertical trusses 110. The fastening hole 737 on the brace 736 is preferably used to lock the top guard rail post 145 in place within the tubular frame scaffolding system 100.

Figure 7B:
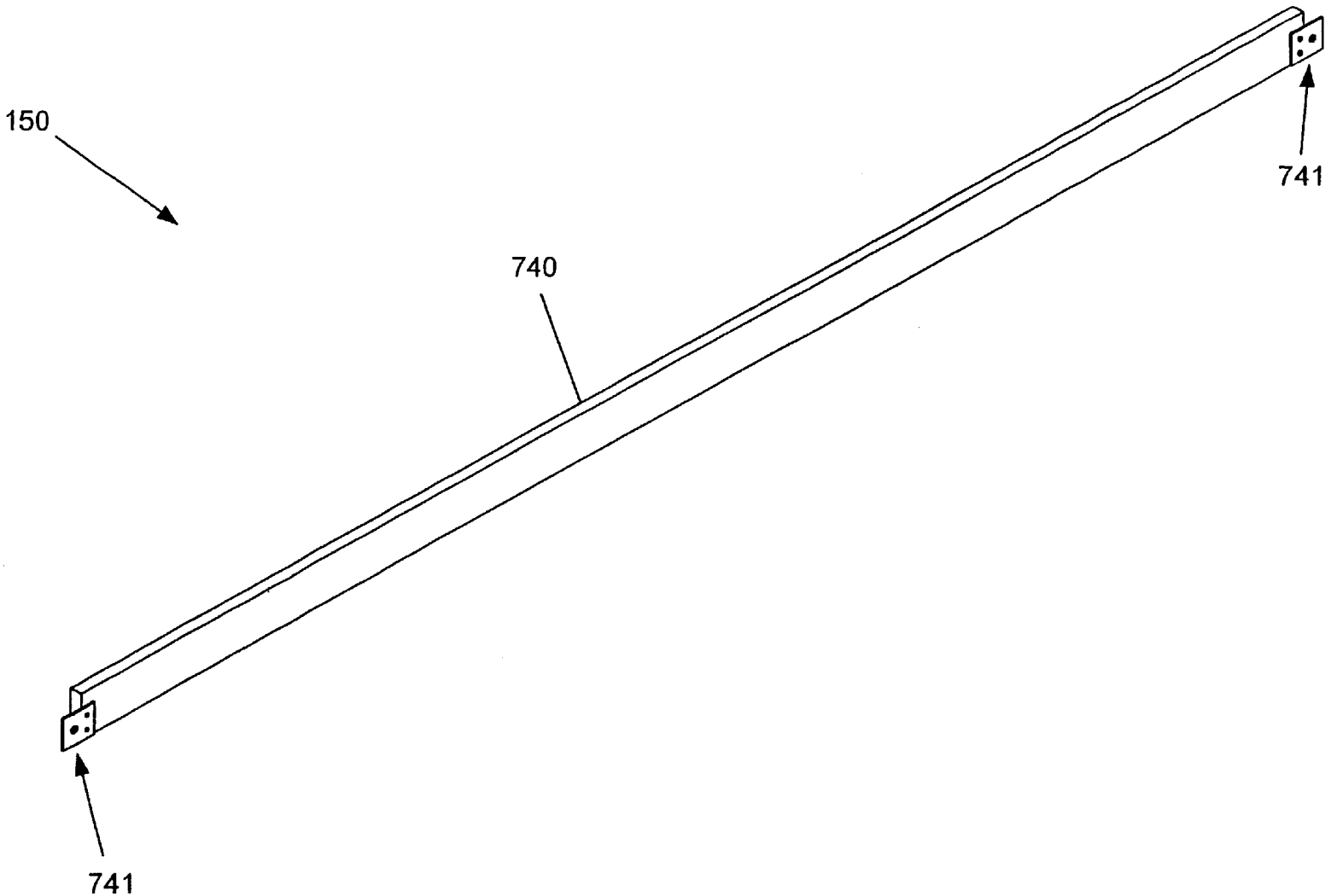
FIG. 7*b* illustrates an embodiment of a toeboard included within the scaffolding system of FIG. 1.
Figure 7C:
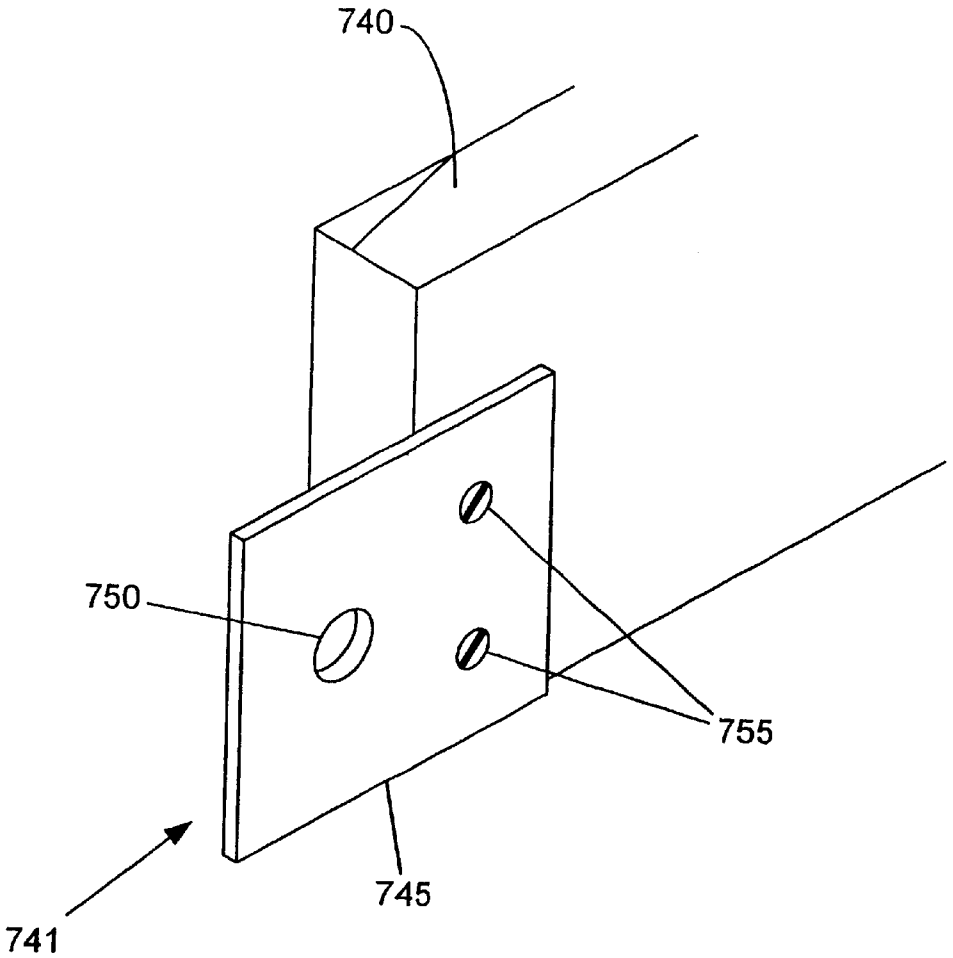
FIG. 7*c* illustrates an embodiment of a coupling device included within the toeboard of FIG. 7*b*.
Figure 7D:
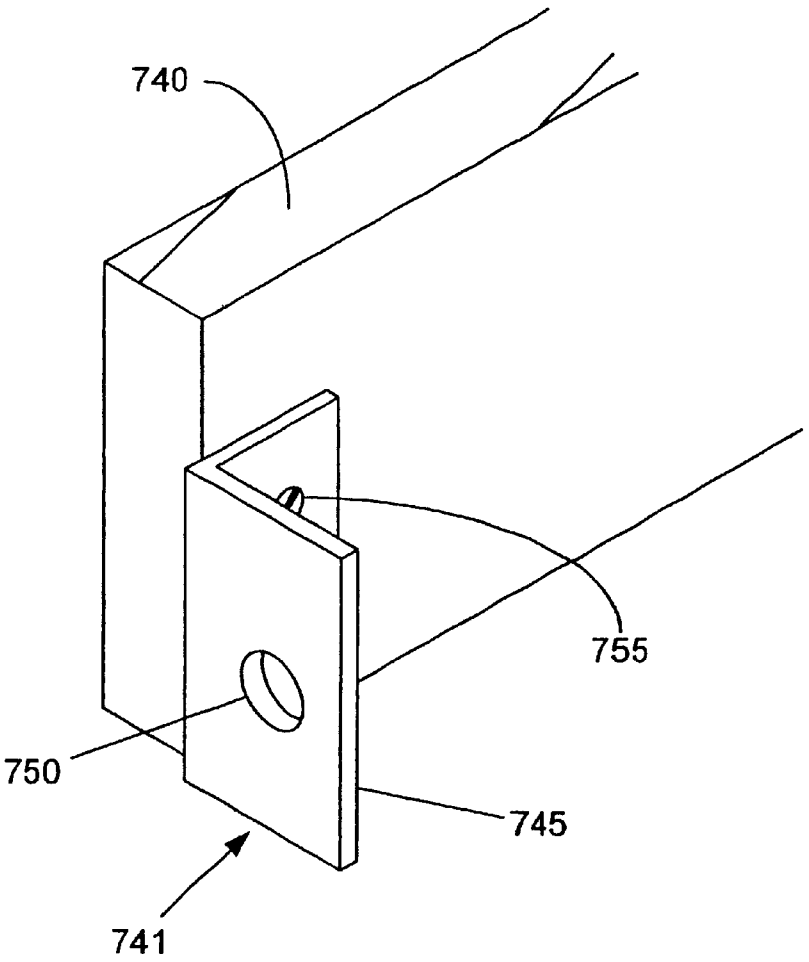
FIG. 7*d* illustrates an alternative embodiment of the coupling device of FIG. 7*c*.

Referring to FIGS. 7*b*, 7*c*, and 7*d*, the toeboards 150 will now be described. The toeboards 150 are preferably coupled to the vertical trusses 110 and the top guard rail posts 145 within the tubular frame scaffolding system 100. In a preferred embodiment, the toeboards 150 are used as a safety device to protect against accidental falls during the use of the tubular frame scaffolding system 100. In a preferred embodiment, as illustrated in FIG. 7*b*, the toeboard 150 includes a board 740 and a connection device 741.

The board 740 may include any number of boards suitable for use as a safety device within the tubular frame scaffolding system 100. The board 740 may be fabricated from any number of commercially available materials suitable for use in the tubular frame scaffolding system 100. In a preferred embodiment, the board 740 is fabricated from wood. In another preferred embodiment, the board 740 is fabricated from steel.

The connection device 741 is preferably used to couple the board 740 to the vertical truss 110 or the top guard rail post 145. In a preferred embodiment, as illustrated in FIGS. 7*c* and 7*d*, the connection device 741 includes a connection plate 745, a keying hole 750, and screws 755.

The connection plate 745 is preferably coupled to the board by the screws 755. The connection plate 745 may be fabricated from any number of materials suitable for creating a connection plate. In a preferred embodiment, the connection plate 745 is a steel plate. In a preferred embodiment, as illustrated in FIG. 7*c*, the connection plate 745 is flat. In another preferred embodiment, as illustrated in FIG. 7*d*, the connection plate 745 is angled.

The keying hole 750 is preferably positioned within the connection plate 745 and is adapted to mate with the coupling devices 320 on the vertical trusses 110 or the keying members 730 on the top guard rail posts 145.

Referring to FIGS. 8*a*, 8*b*, 8*c*, 8*d*, 8*e*, 8*f*, 8*g*, 8*h*, 8*i*, 8*j*, 8*k*, 8*l*, 8*m*, and 8*n*, a method of assembling the tubular frame scaffolding system 100 will now be described.

Figure 8A:
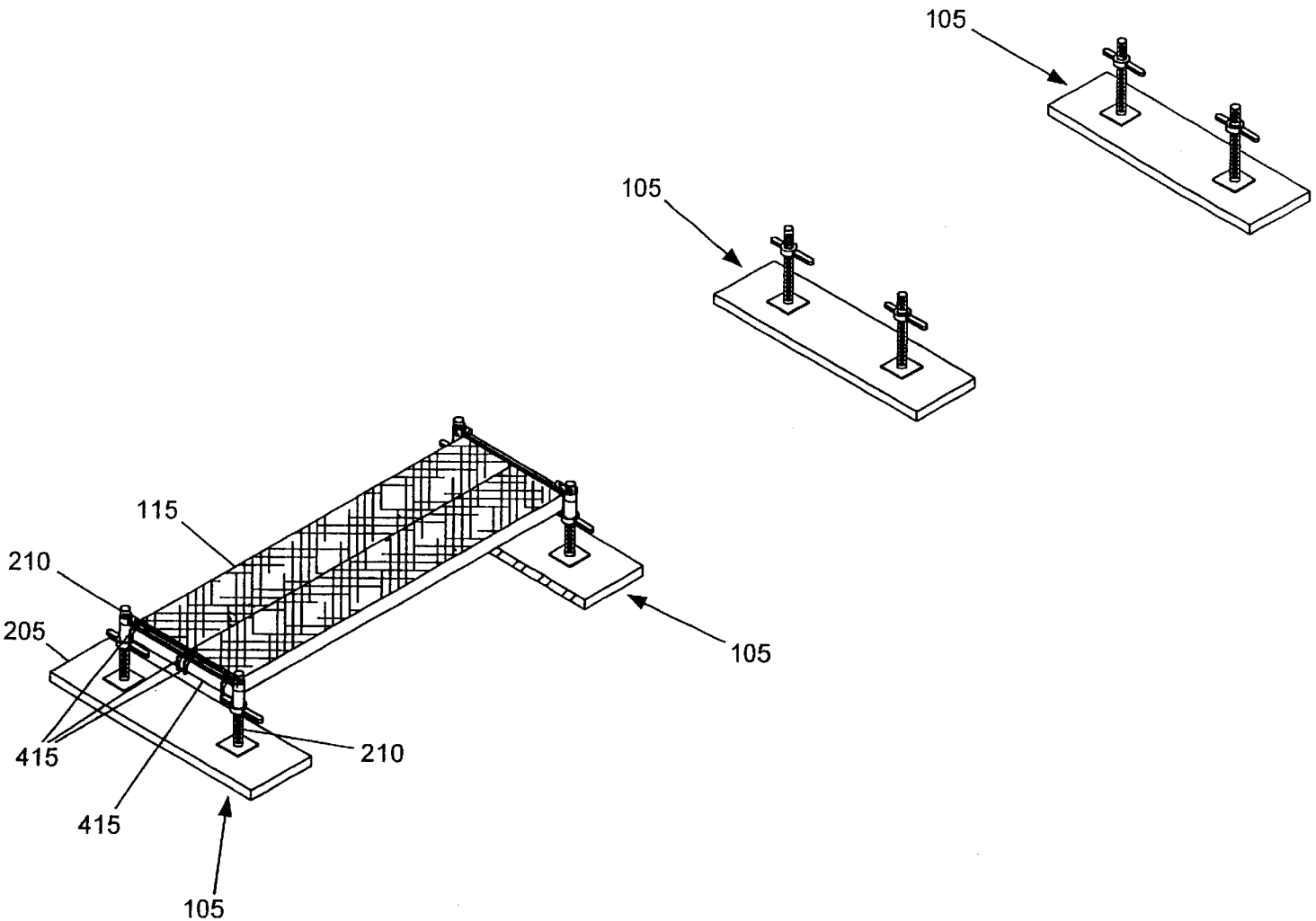
FIG. 8*a* illustrates a scaffolding system including base pads and a work platform.

In a preferred embodiment, as illustrated in FIG. 8*a*, the work platform 115 is attached to the base pads 105. The work platform 115 may be attached to the base pads 105 using any number of conventional commercially available methods suitable for attaching the work platform 115 to the base pads 105. In a preferred embodiment, the work platform 115 is attached to the base pads 105 by screwing the work platform 115 into the threaded screw connectors 210.

Figure 8B:
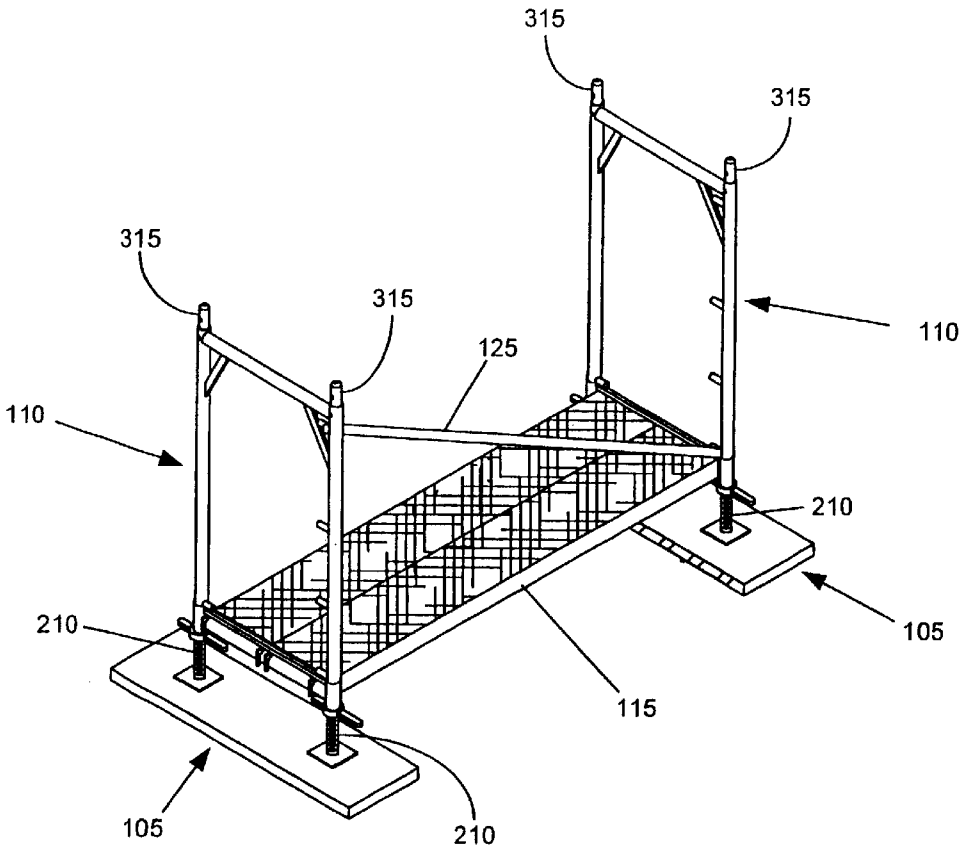
FIG. 8*b* illustrates an embodiment of the scaffolding system of FIG. 8*a* after the addition of vertical trusses and a diagonal brace.

Next, as illustrated in FIG. 8*b*, the vertical trusses 110 are attached to the work platform 115 and the base pad 105, and the diagonal support brace 125 is coupled to the vertical trusses 110. The vertical trusses 110 may be attached to the base pad 105 and work platform 115 using any number of conventional commercially available methods suitable for attaching the vertical trusses 110 to the base pads 105. In a preferred embodiment, the vertical trusses 110 are coupled to the base pads 105 by mating the bottom mating conduits 340 with the threaded screw connectors 210. The diagonal support brace 125 may be coupled to the vertical trusses 110 using any number of conventional commercially available methods suitable for coupling the diagonal support brace 125 to the vertical trusses 110. In a preferred embodiment, the diagonal support brace 125 is coupled to the vertical trusses 10 by mating the diagonal support brace 125 with the coupling devices 320 on the vertical trusses 110.

Figure 8C:
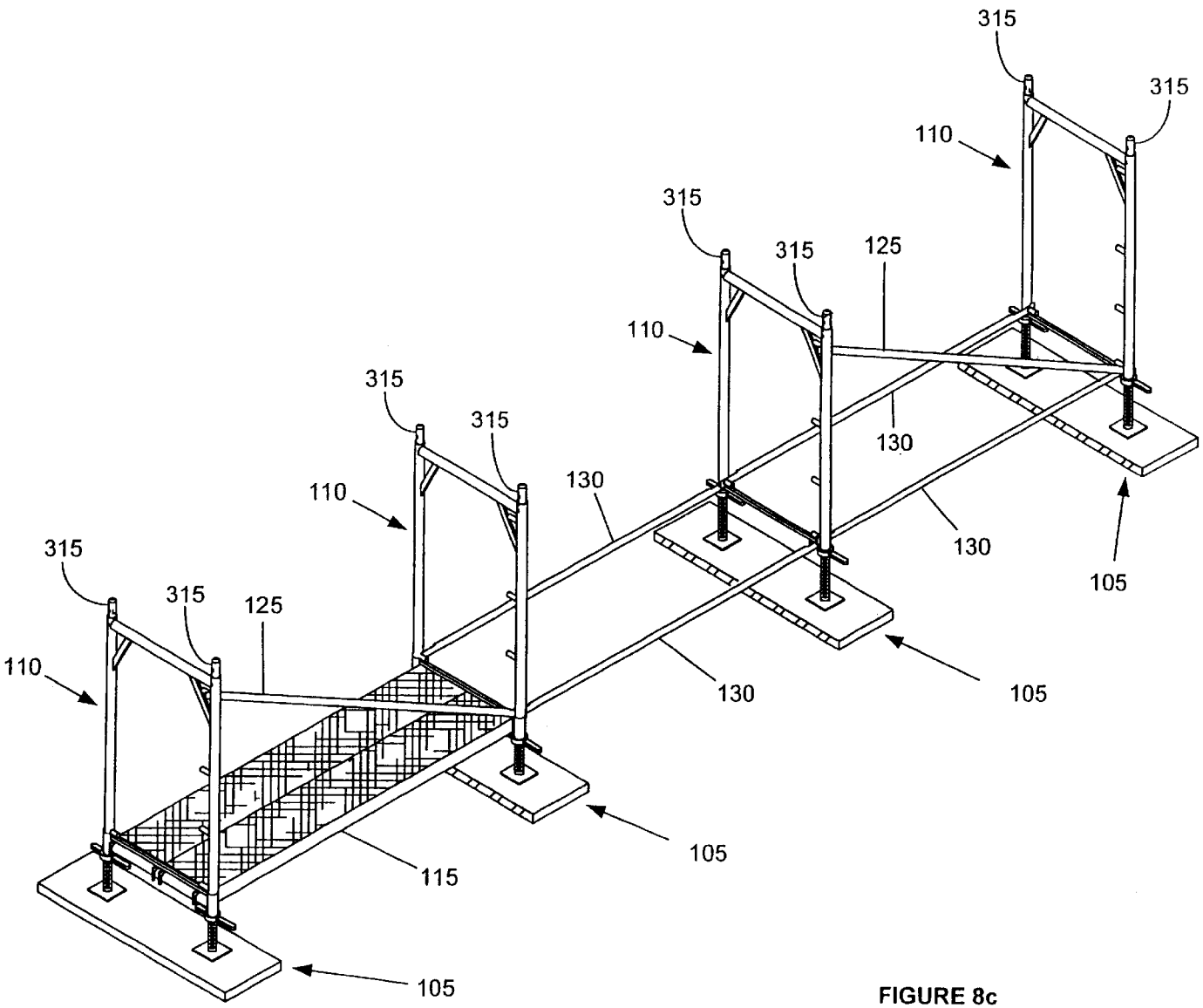
FIG. 8*c* illustrates an embodiment of the scaffolding system of FIG. 8*b* in which a plurality of the scaffolding systems are attached in series.

Next, as illustrated in FIG. 8*c*, additional base pads 105, vertical trusses 110, and diagonal support braces 125 are added to the tubular frame scaffolding system 100. The base pads 105, the vertical trusses 110, and the diagonal support braces 125 may be added as desired to extend the length of the tubular frame scaffolding system 100. In a preferred embodiment, the horizontal guard rails 130 are coupled the vertical trusses 110 to connect the vertical trusses 110 and to provide stability to a base of the tubular frame scaffolding system 100. In a preferred embodiment, the horizontal guard rails 130 are coupled to the base pads 105 by mating with the coupling devices 320 on the vertical trusses 110.

Figure 8D:
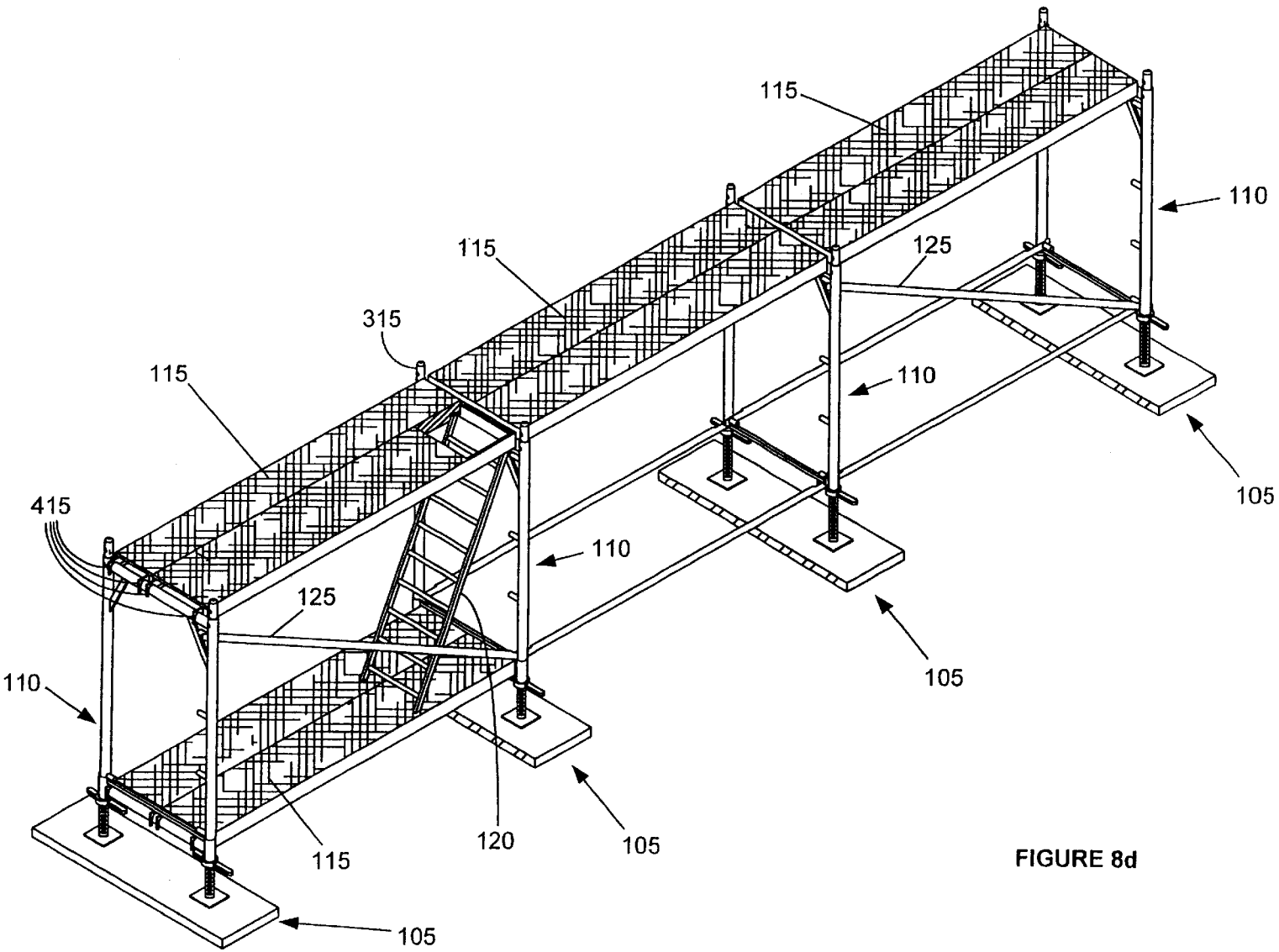
FIG. 8*d* illustrates an embodiment of the scaffolding system of FIG. 8*c* including additional work platforms.

Next, as illustrated in FIG. 8*d*, the work platforms 115 and the platform systems 400 are added to the tubular frame scaffolding system 100 to create another level in the tubular frame scaffolding system 100. The work platforms 115 and platform systems 400 may be added to the tubular frame scaffolding system 100 using any number of conventional commercially available methods of adding work platforms and platform systems to a scaffolding system. In a preferred embodiment, the work platforms 115 and platform systems 400 are added to the tubular frame scaffolding system 100 by coupling the hooks 415 on the work platforms 115 to the horizontal support bars 310 in the vertical trusses 110.

Figure 8E:
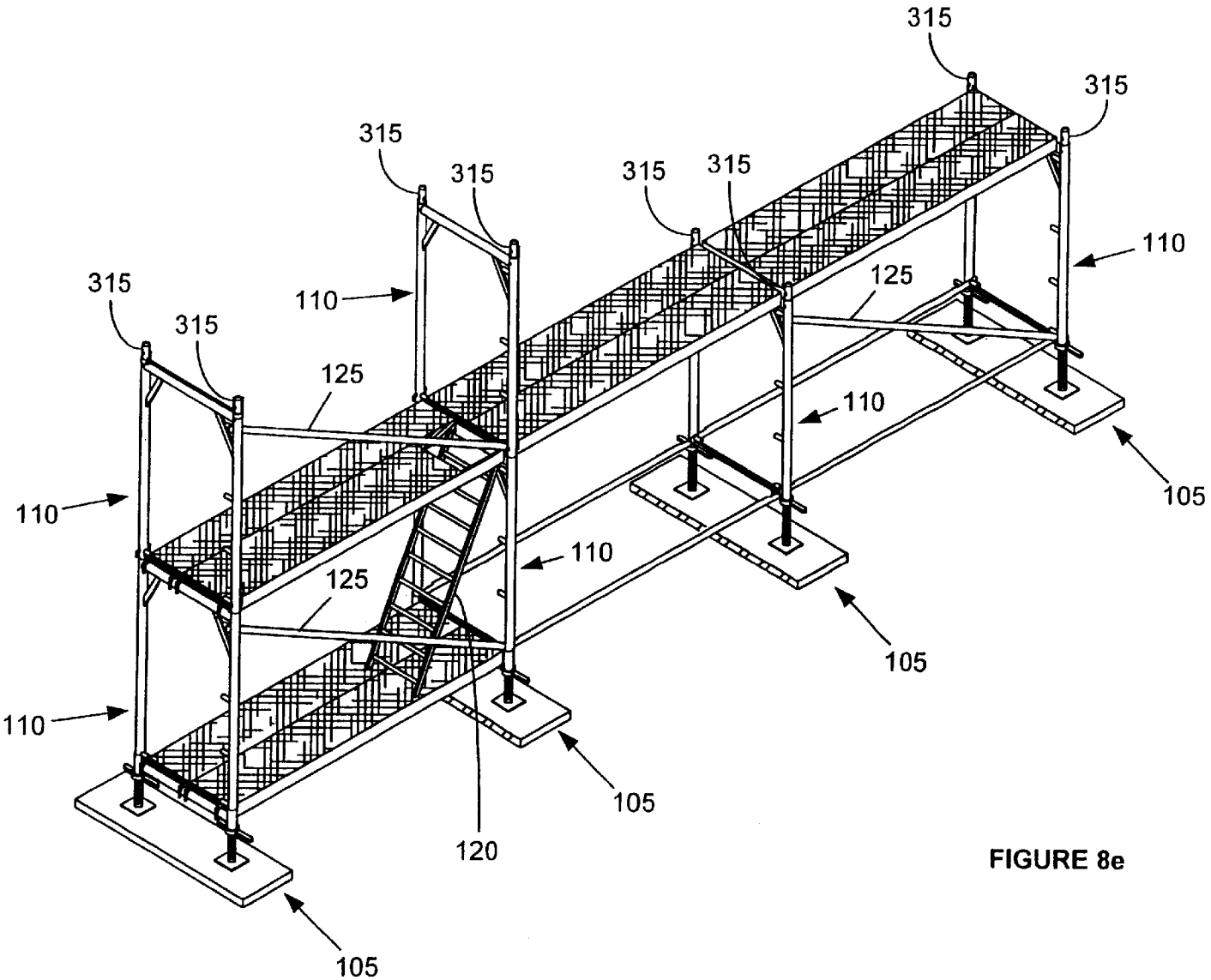
FIG. 8*e* illustrates an embodiment of the scaffolding system of FIG. 8*d* including additional vertical trusses and a diagonal support brace.
Figure 8F:
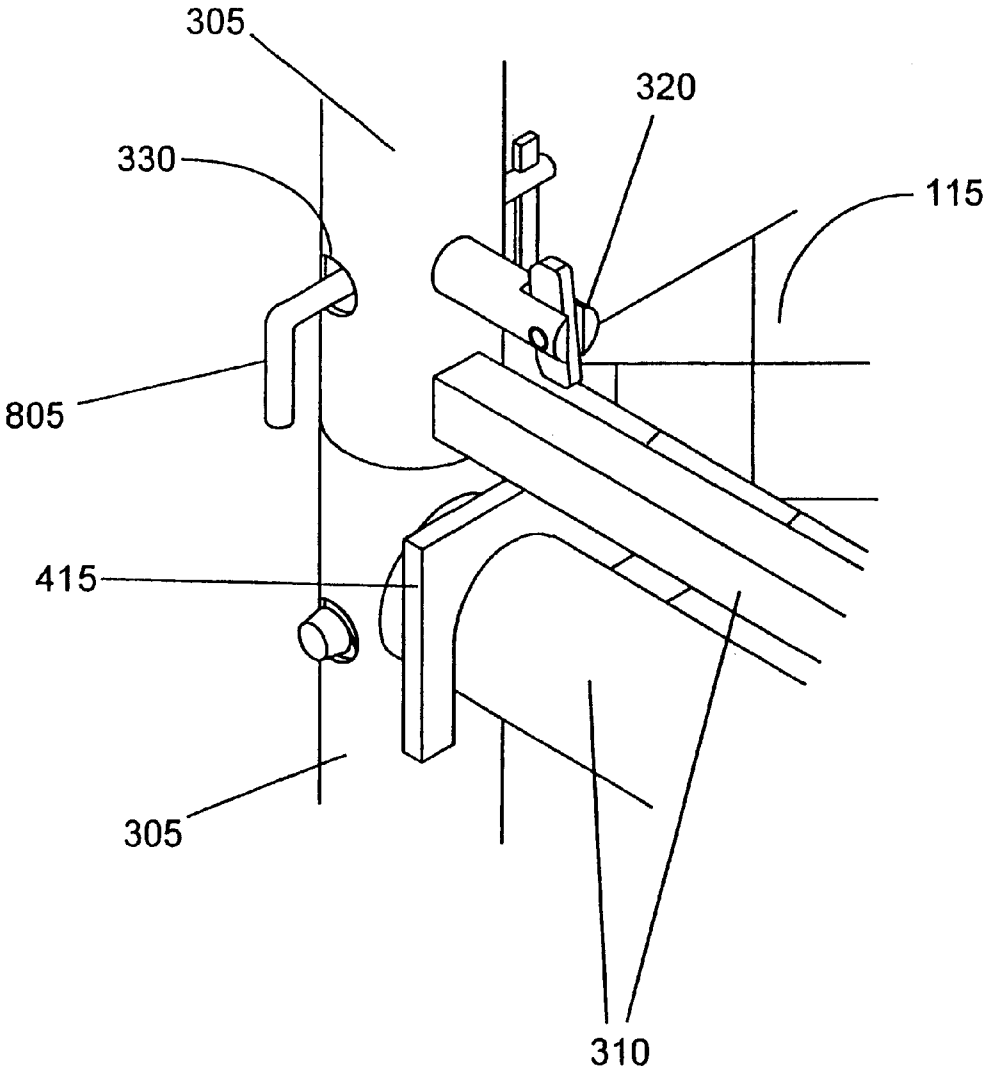
FIG. 8*f* illustrates an embodiment of the coupling of a top of a vertical truss to a bottom of another vertical truss.

Next, as illustrated in FIG. 8*e*, the vertical trusses 110 and the diagonal support bars 125 are added to the tubular frame scaffolding system 100. The vertical trusses 110 may be added to the tubular frame scaffolding system 100 using any number of methods suitable for adding vertical trusses 110 to the system 100. In a preferred embodiment, as illustrated in FIG. 8*f*, the vertical trusses 110 are added to the system 100 by mating the bottom mating conduits 340 on the vertical trusses 110 to the vertical extensions 315 on the vertical trusses 110 already within the system 100. The bottom fastening holes 330 on the bottom mating conduit 340 are preferably aligned with the top fastening holes 335 in the vertical extensions 315. Then, a toggle pin 805 is preferably inserted into the fastening holes 330, 335 to secure the connection between the vertical trusses 110 within the tubular frame scaffolding system 100.

The diagonal support brace 125 may be coupled to the vertical trusses 110 using any number of conventional commercially available methods suitable for coupling the diagonal support brace 125 to the vertical trusses 110. In a preferred embodiment, the diagonal support brace 125 is coupled to the vertical trusses 110 by mating the diagonal support brace 125 with the coupling devices 320 on the vertical trusses 110.

Figure 8G:
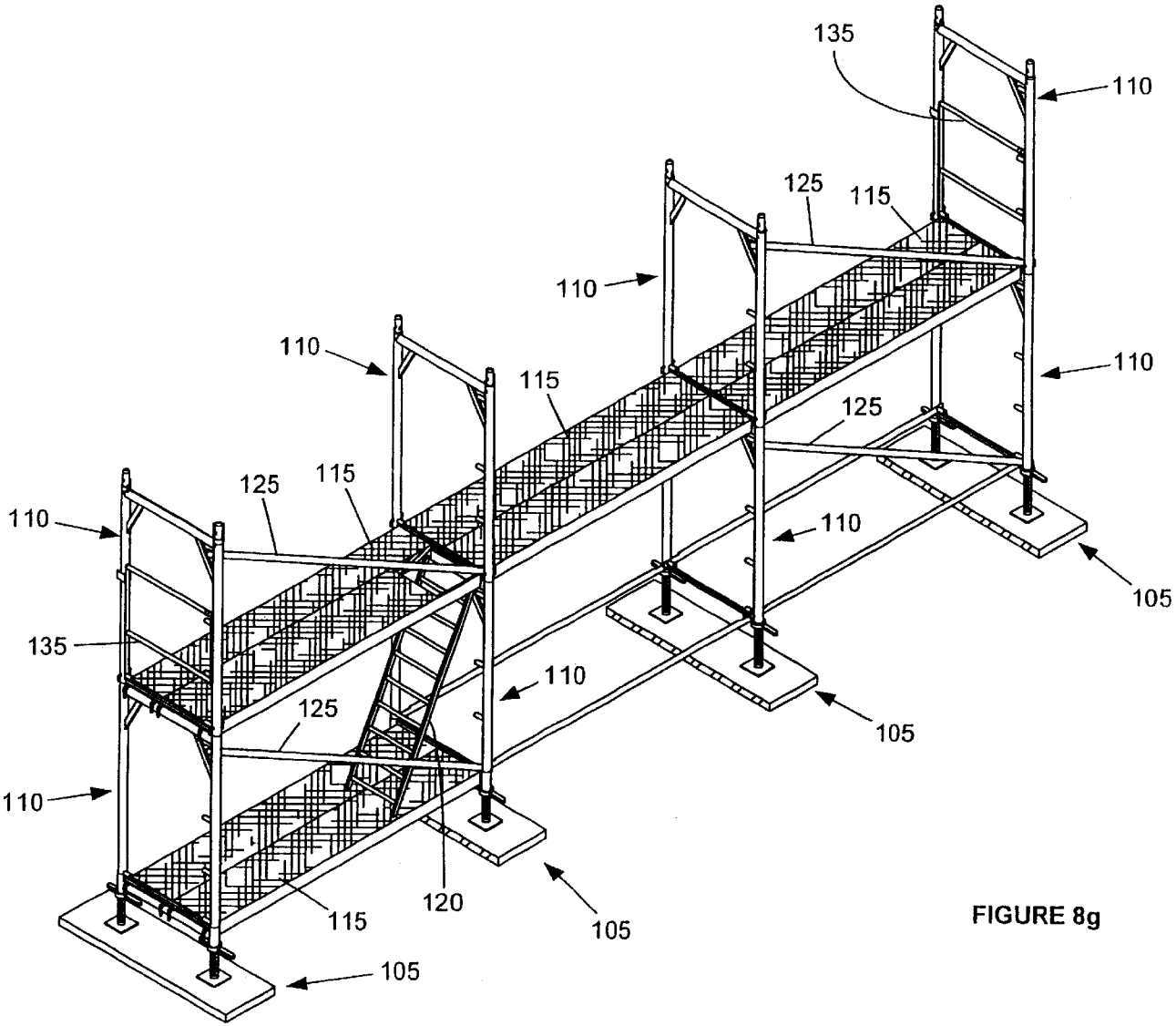
FIG. 8*g* illustrates an embodiment of the scaffolding system of FIG. 8*e* including additional vertical trusses, a diagonal support brace, and an intermediate guard rail.
Figure 8H:
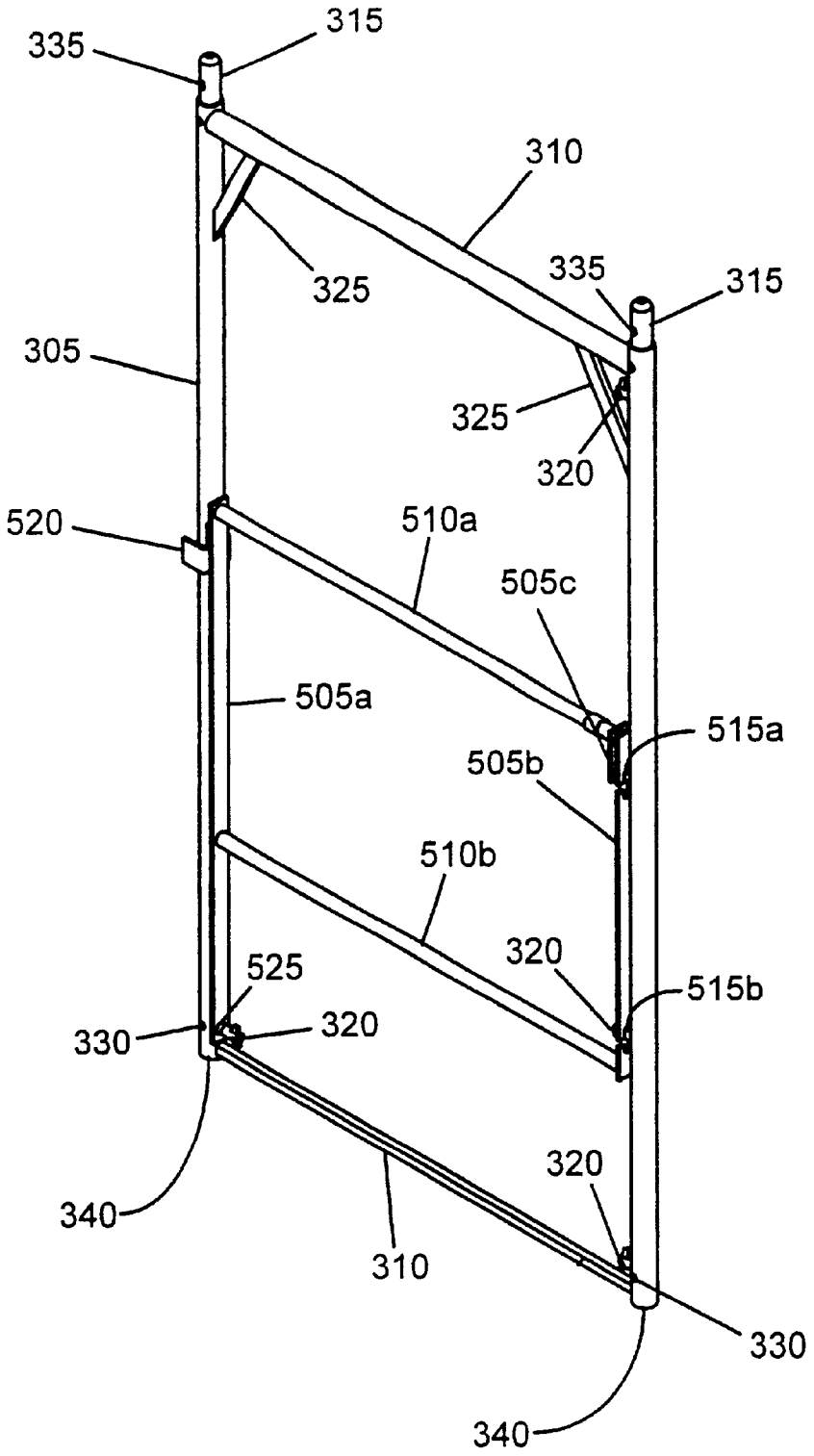
FIG. 8*h* illustrates an embodiment of the intermediate guard rail of FIG. 8*g* coupled to the vertical truss.
Figure 8I:
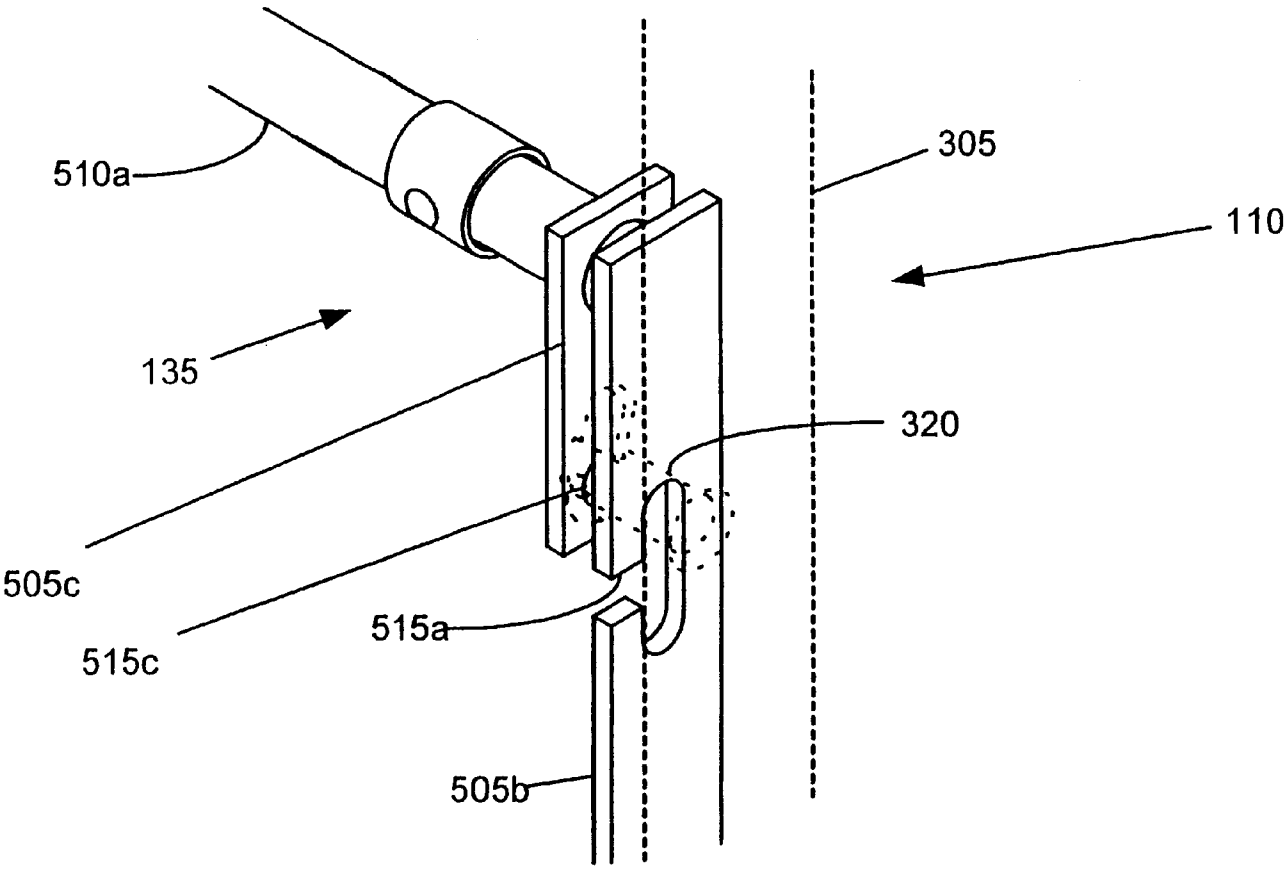
FIG. 8*i* illustrates an embodiment of a keying slot in the intermediate guard rail of FIG. 8*h* coupled to a fastener on the vertical truss.
Figure 8J:
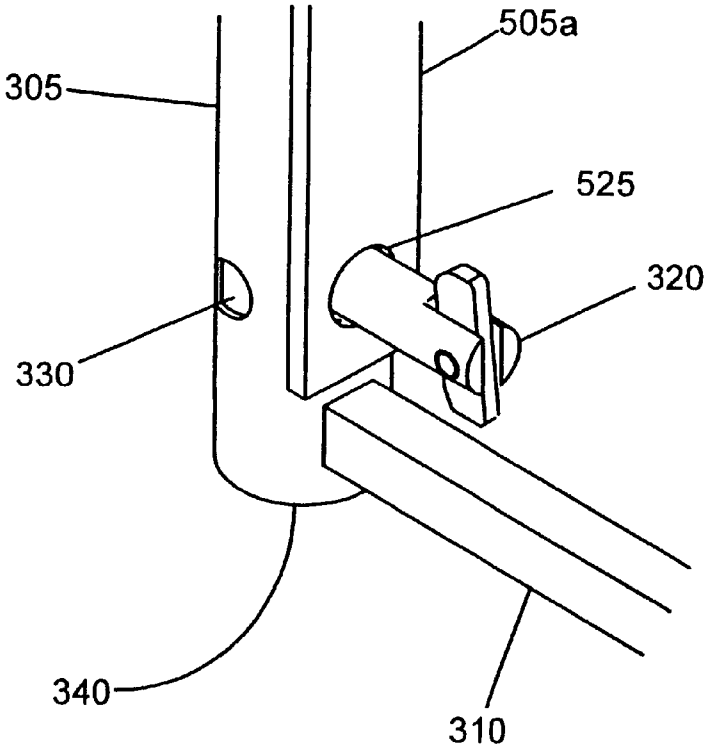
FIG. 8*j* illustrates an embodiment of an opening in the intermediate guard rail of FIG. 8*h* coupled to a fastener on the vertical truss.

Next, as illustrated in FIGS. 8*g*, the intermediate guard rail panels 135 are added to the tubular frame scaffolding system 100. The intermediate guard rail panels 135 may be added to the tubular frame scaffolding system 100 using any number of conventional commercially available methods of adding a guard rail panel to the system 100. In a preferred embodiment, as illustrated in FIG. 8*h*, the intermediate guard rail panels 135 are coupled to the vertical trusses 110 within the tubular frame scaffolding system 100. The braces 520 preferably mate with the vertical support bars 305 in the vertical trusses 110 to position the intermediate guard rail panels 135 within the tubular frame scaffolding system 100. In a preferred embodiment, as illustrated in FIGS. 8*i* and 8*j*, the coupling devices 320 on the vertical trusses 110 preferably mate with the keying slots 515*a*, 515*b*, and 515*c* and the opening 525 in the intermediate guard rail panels 135 to securely fasten the intermediate guard rail panels 135 within the vertical trusses 110.

Figure 8K:
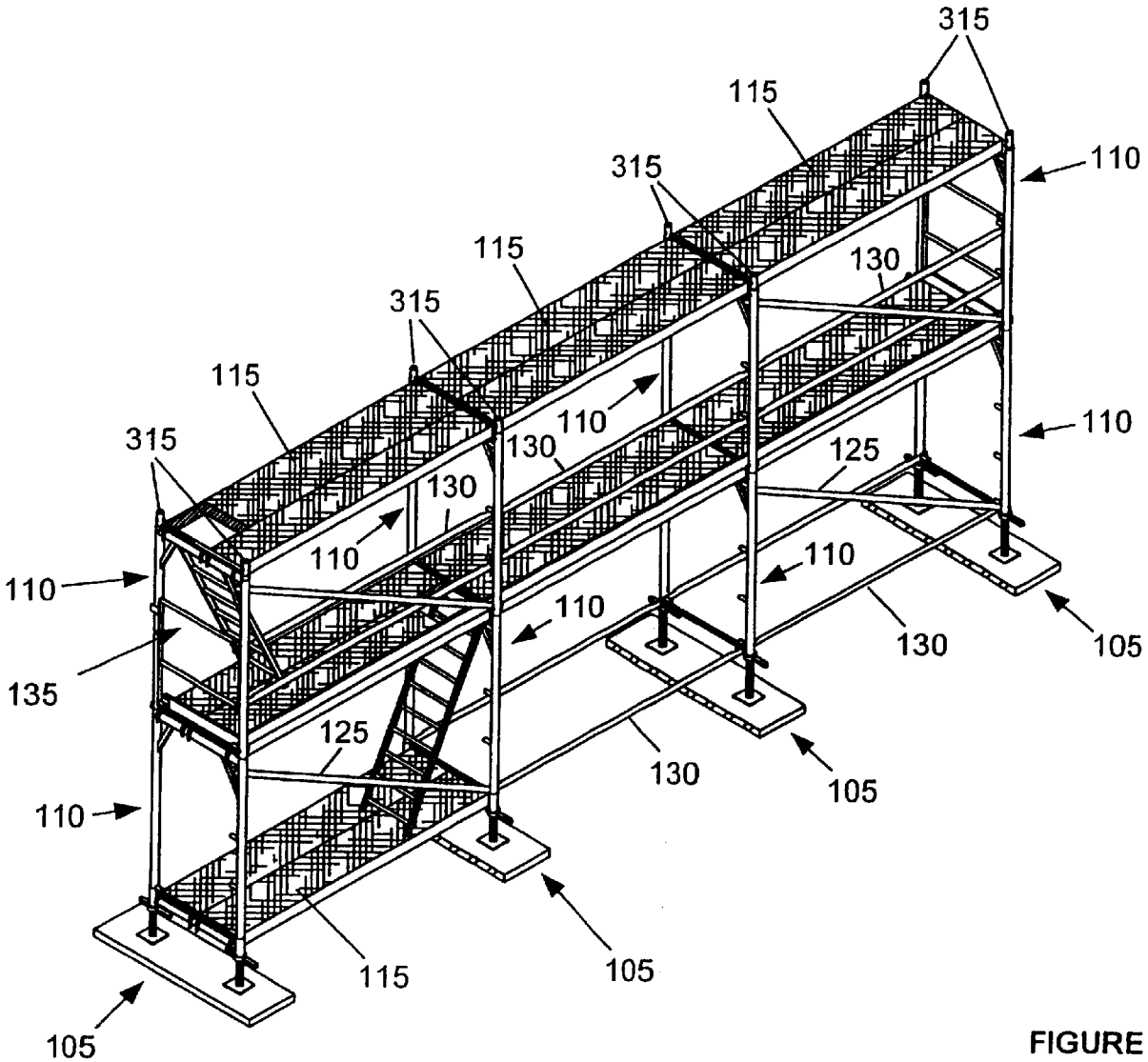
FIG. 8*k* illustrates an embodiment of the scaffolding system of FIG. 8*g* including additional work platforms.
Figure 8I:
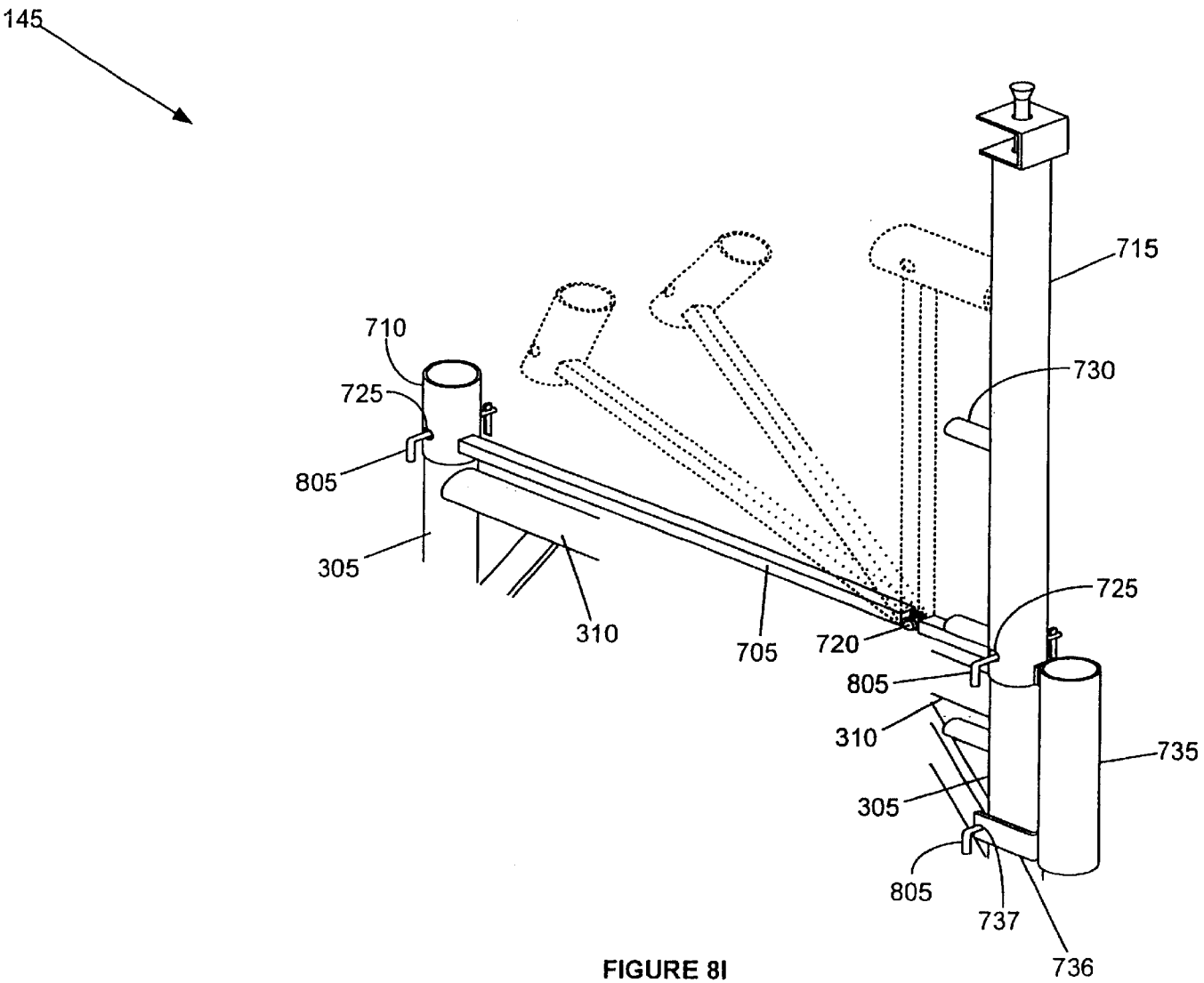

Next, as illustrated in FIG. 8*k*, the work platforms 115 and the platform systems 400 are added to the tubular frame scaffolding system 100 to create another level in the tubular frame scaffolding system 100. Additionally, the horizontal guard rails 130 are added to one side of the tubular frame scaffolding system 100 as a safety measure to provide protection against accidental falls from the platforms 115.

The work platforms 115 and platform systems 400 may be added to the tubular frame scaffolding system 100 using any number of conventional commercially available methods of adding work platforms 115 and platform systems 400 to the scaffolding system 100. In a preferred embodiment, the work platforms 115 and platform systems 400 are added to the tubular frame scaffolding system 100 by coupling the hooks 415 on the work platforms 115 to the horizontal support bars 310 in the vertical trusses 110.

The horizontal guard rails 130 may be added to the tubular frame scaffolding system 100 using any number of conventional commercially available methods of adding guard rails to a scaffolding system. In a preferred embodiment, the horizontal guard rails 130 are added to the system 100 by coupling the guard rails 130 to the coupling devices 320 on the vertical trusses 110.

Next, in a preferred embodiment, the top guard rail posts 145 are added to the system 100. The top guard rail posts 145 are preferably added to the tubular frame scaffolding system 100 to form a top level of the tubular frame scaffolding system 100. The top guard rail posts 145 may be added to the tubular frame scaffolding system 100 using any number of methods suitable for adding the posts 145 to the tubular frame scaffolding system 100. In a preferred embodiment, as illustrated in FIG. 8*l*, the top guard rail posts 145 are added to the tubular frame scaffolding system 100 by mating the bottom mating conduits 738 in the vertical support bars 715 and the mating conduits 726 in the caps 710 with the vertical extensions 315 on the trusses 110. In a preferred embodiment, the braces 736 mate with the vertical support bars 305 on the trusses 110 to position the top guard rail posts 145 within the tubular frame scaffolding system 100. In a preferred embodiment, the toggle pins 805 are inserted into the fastening holes 725, 737 to securely fasten the top guard rail posts 145 within the tubular frame scaffolding system 100.

In a preferred embodiment, the horizontal guard rails 130 are coupled to the top guard rail posts 145 as a safety measure to protect against accidental falls from the top level of the tubular frame scaffolding system 100. The horizontal guard rails 130 are preferably coupled to the top guard rail posts 145 by mating the horizontal guard rails 130 with the keying members 730 on the top guard rail posts 145.

Next, in a preferred embodiment, the top guard rail panels 140 are added to the system 100. The top guard rail panels 140 are preferably added to the tubular frame scaffolding system 100 as a safety measure to protect against accidental falls from the top level of the tubular frame scaffolding system 100. The top guard rail panels 140 may be added to the tubular frame scaffolding system 100 using any number of methods suitable for adding the panels 140 to the tubular frame scaffolding system 100. In a preferred embodiment, the top guard rail panels 140 are added to the tubular frame scaffolding system 100 by mating the mating conduits 625 in the vertical support bars 605 with the vertical extensions 315 on the trusses 110. In a preferred embodiment, toggle pins 805 are inserted into the fastening holes 626 to secure the top guard rail panels 140 within the tubular frame scaffolding system 100.

In a preferred embodiment, the horizontal guard rails 130 are coupled to the top guard rail panels 140 as a safety measure to protect against accidental falls from the top level of the tubular frame scaffolding system 100. The horizontal guard rails 130 are preferably coupled to the top guard rail panels 140 by mating the horizontal guard rails 130 with the keying members 615 and the guard rail holders 620 on the top guard rail panels 140.

Finally, in a preferred embodiment, the toeboards 150 are added to the system 100. The toeboards 150 are preferably added to the system 100 to act as a safety device to prevent accidental falls during the use of the system 100. The toeboards 150 may be added to the system 100 using any method suitable for adding the toeboards 150 to the system 100. The toeboards 150 are preferably added to the tubular frame scaffolding system 100 by coupling the connection devices 741 to the vertical trusses 110, the top guard rail posts 145, and the top guard rail panels 140.

Figure 8M:
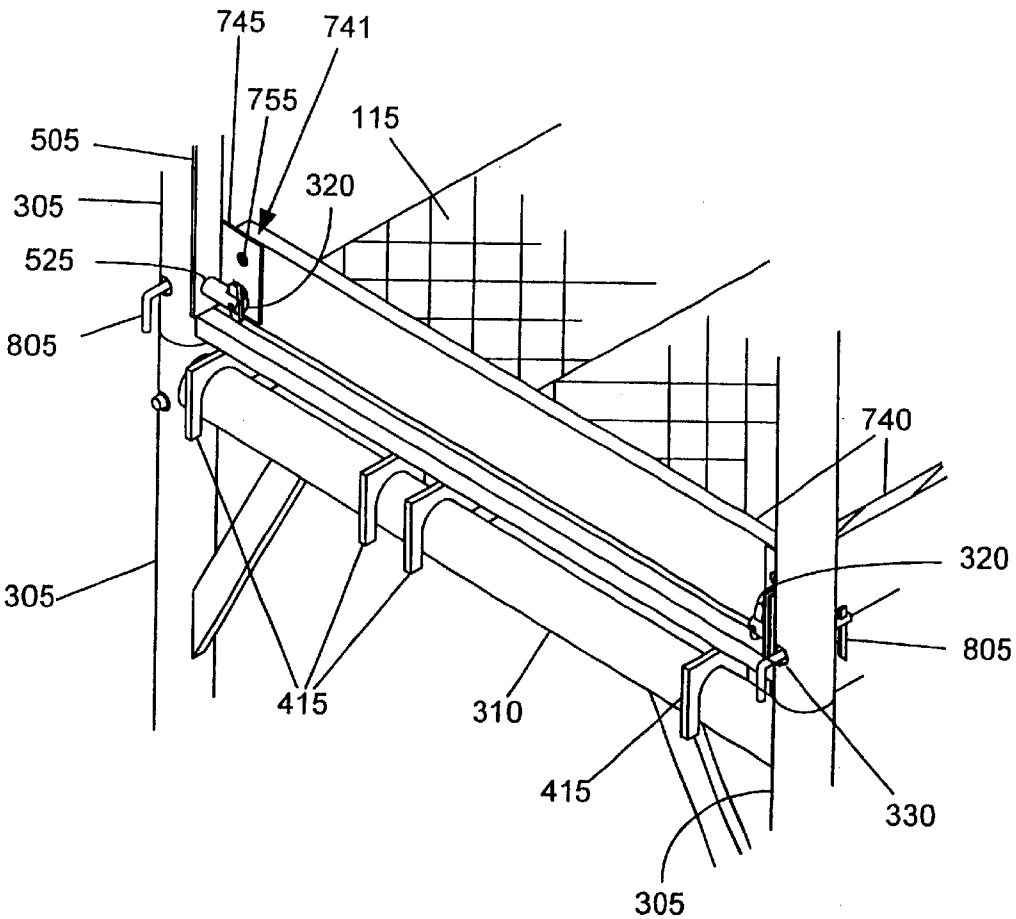
FIG. 8*m* illustrates an embodiment of the toeboard of FIG. 7*b* coupled to the scaffolding system of FIG. 8*k*.

In a preferred embodiment, as illustrated in FIG. 8*m*, the coupling devices 741 are coupled to the trusses 110, the top guard rail posts 145, and the top guard rail panels 140 by aligning the keying holes 750 in the coupling devices 741 with the fastening holes 330, 626, 725. The toggle pins 805 are then inserted into the keying holes 750 and the fastening holes 330, 626, 725 to secure the toeboards 150 within the tubular frame scaffolding system 100.

Figure 8N:
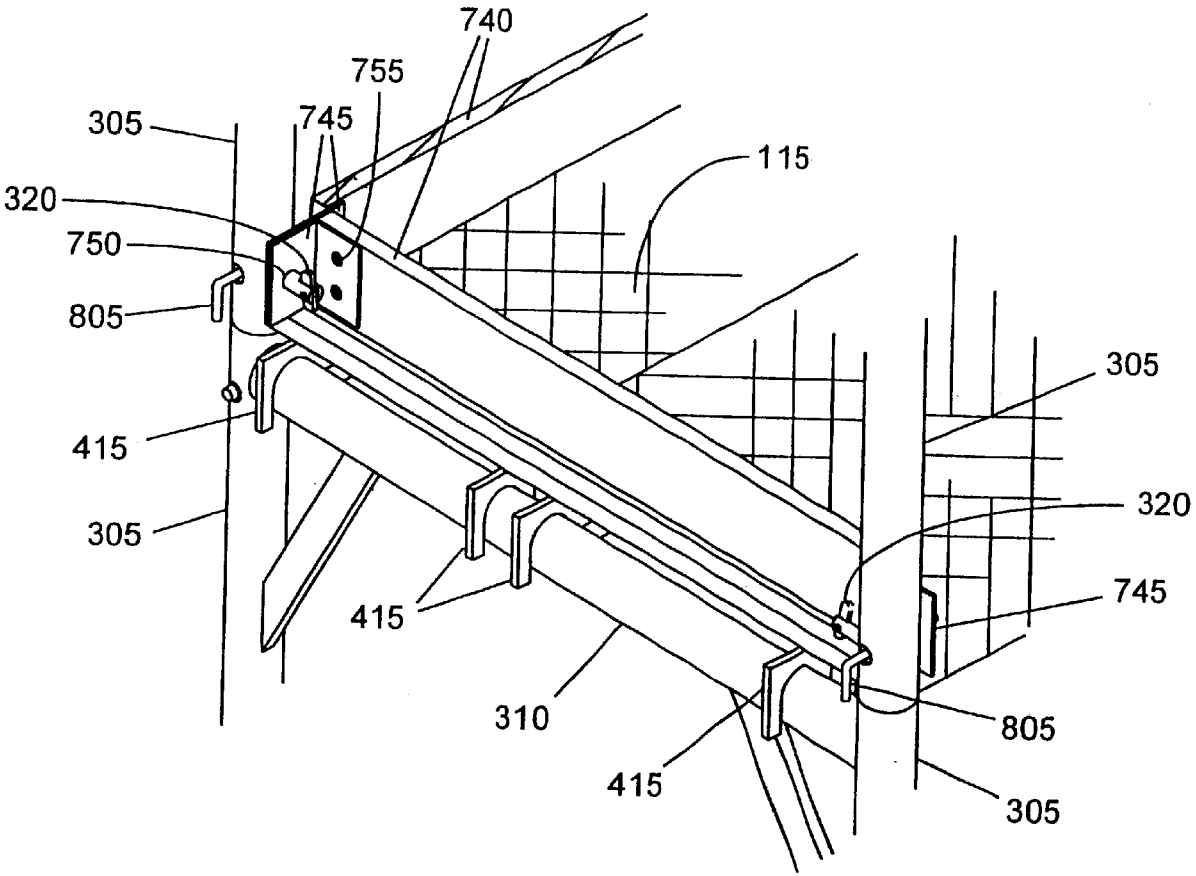
FIG. 8*n* illustrates an embodiment of the toeboard of FIG. 7*c* coupled to the scaffolding system of FIG. 8*k*.

In another preferred embodiment, as illustrated in FIG. 8*n*, the coupling devices 741 are coupled to the trusses 110, the top guard rail posts 145, and the top guard rail panels 140 by mating the keying holes 750 in the coupling devices 741 with the coupling devices 320 and the keying members 615, 730 to secure the toeboards 150 within the tubular frame scaffolding system 100.

A tubular scaffolding system has been described that includes a plurality of base pads for providing a foundation for the scaffolding system, a plurality of tubular vertical trusses for forming the skeleton of the scaffolding system, one or more work platforms coupled to the vertical trusses, one or more access ladders coupled to the work platforms, one or more horizontal guard rails coupled to the vertical trusses, and one or more diagonal support braces coupled to the vertical trusses. In a preferred embodiment, the scaffolding system further includes one or more intermediate guard rail panels coupled to one or more of the vertical trusses. In a preferred embodiment, the scaffolding system further includes one or more top guard rail posts coupled to one or more vertical trusses and one or more work platforms, and one or more horizontal guard rails coupled to the top guard rail posts. In a preferred embodiment, the scaffolding system further includes one or more top guard rail panels coupled to one or more vertical trusses. In a preferred embodiment, the scaffolding system further includes one or more toeboards coupled to the vertical trusses. In a preferred embodiment, the scaffolding system further includes one or more top guard rail posts and one or more top guard rail panels, and the toeboards are coupled to the top guard rail posts and the top guard rail panels. In a preferred embodiment, the access ladder is integrated into the work platform.

A platform system for detachable affixation on a tubular frame scaffolding has been described that includes a work platform, an access ladder coupled to the work platform, one or more hooks for coupling a top end of the access ladder to the work platform, and a latching device for supporting a bottom end of the access ladder beneath the work platform. In a preferred embodiment, the latching device includes a latching body for mating with the access ladder and one or more latch covers for securing the access ladder within the latching body.

An intermediate guard rail panel for detachable affixation on tubular frame scaffolding has been described that includes a plurality of vertical support bars and one or more horizontal support bars fixedly attached to the vertical support posts. In a preferred embodiment, the vertical support posts include one or more keying slots for coupling the intermediate guard rail panel to the tubular frame scaffolding. In a preferred embodiment, the vertical support posts include one or more braces for coupling the intermediate guard rail panel to the tubular frame scaffolding.

A top guard rail post for use on a tubular frame scaffolding system has been described that includes a fixed vertical support post, a horizontal post for supporting a work platform coupled to the fixed vertical support post, and a hinge for coupling the fixed vertical support post to the horizontal support post. In a preferred embodiment, the top guard rail post further includes a mating conduit positioned within the vertical support post for coupling the top guard rail post to the tubular frame scaffolding system. In a preferred embodiment, the fixed vertical support post includes a fastening hole adapted to accept a toggle pin and an outrigger adapted to attach to a vertical scaffold member. In a preferred embodiment, the horizontal support post includes a cap adapted to attach to the tubular frame scaffolding system.

A method of assembling a scaffolding system has been described that includes placing a plurality of base pads on a ground surface, coupling a plurality of tubular vertical trusses to the base pads to form a skeleton for the scaffolding system, attaching one or more platform systems to the vertical trusses, coupling one or more horizontal guard rails and one or more diagonal support braces to the vertical trusses, and coupling one or more top guard rail posts to the tubular vertical trusses at the top of the scaffolding system. In a preferred embodiment, the platform system includes a work platform and a plurality of hooks for coupling the work platform to the vertical trusses. In a preferred embodiment, the platform system further includes an access ladder coupled to the work platform. In a preferred embodiment, the top guard rail post includes a fixed vertical support post, a horizontal post for supporting the work platform coupled to the fixed vertical support post, and a hinge for coupling the fixed vertical support post to the horizontal support post. In a preferred embodiment, the base pad includes a base support and one or more threaded screw connectors for coupling the base support to the vertical trusses. In a preferred embodiment, the method further includes attaching one or more toeboards to the tubular frame scaffolding system. In a preferred embodiment, the toeboard includes a board and a connection device for coupling the board to the tubular frame scaffolding system. In a preferred embodiment, the method further includes attaching one or more intermediate guard rail panels to the tubular frame scaffolding system. In a preferred embodiment, the intermediate guard rail panel includes a plurality of vertical support bars, one or more horizontal support bars fixedly attached to the vertical support posts, one or more keying slots positioned within the vertical support bars for coupling the intermediate guard rail panel to the tubular frame scaffolding system, and one or more braces for coupling the intermediate guard rail panel to the tubular frame scaffolding system. In a preferred embodiment, the method further includes attaching one or more top guard rail panels to the tubular frame scaffolding system. In a preferred embodiment, the top guard rail panel includes a plurality of vertical support bars one or more horizontal support bars coupled to the vertical support bars, one or more mating conduits within the vertical support bars, one or more keying members, and one or more fastening holes in the vertical support bars.

A method of affixing a vertical truss to a tubular frame scaffolding system has been described that includes mating the vertical truss to the tubular frame scaffolding system and fastening the vertical truss to the tubular frame scaffolding system with a toggle pin. In a preferred embodiment, the vertical truss includes one or more mating conduits and one or more fastening holes, the mating conduits are used to mate the truss to the tubular frame scaffolding system, and the toggle pins are inserted into the fastening holes to secure the vertical truss within the tubular frame scaffolding system.

A method of affixing a top guard rail panel to a tubular frame scaffolding system has been described that includes mating the top guard rail panel to the tubular frame scaffolding system and fastening the top guard rail panel to the tubular frame scaffolding system with a toggle pin. In a preferred embodiment, the top guard rail panel includes one or more mating conduits and one or more fastening holes, the mating conduits are used to mate the top guard rail panel to the tubular frame scaffolding system, and the toggle pins are inserted into the fastening holes to secure the top guard rail panel within the tubular frame scaffolding system.

A method of affixing a top guard rail post to a tubular frame scaffolding system has been described that includes mating the top guard rail post to the tubular frame scaffolding system and fastening the top guard rail post to the tubular frame scaffolding system with a toggle pin. In a preferred embodiment, the top guard rail post includes one or more mating conduits and one or more fastening holes, the mating conduits are used to mate the top guard rail panel to the tubular frame scaffolding system, and the toggle pins are inserted into the fastening holes to secure the vertical truss within the tubular frame scaffolding system. In a preferred embodiment, the top guard rail post further includes a brace, and the brace mates with the tubular frame scaffolding system to secure the top guard rail post within the tubular frame scaffolding system.

A method of affixing an intermediate guard rail panel to a tubular frame scaffolding system has been described that includes mating the intermediate guard rail panel to the tubular frame scaffolding system. In a preferred embodiment, the intermediate guard rail panel includes one or more keying slots, and the keying slots are used to mate the intermediate guard rail panel within the tubular frame scaffolding system. In a preferred embodiment, the intermediate guard rail panel further includes a brace, and the brace mates with the tubular frame scaffolding system to secure the intermediate guard rail panel within the tubular frame scaffolding system.

Although illustrative embodiments have been shown and described, a wide range of modification, changes, and substitution is contemplated in the foregoing disclosure. In some instances, some features of the disclosed embodiments may be employed without a corresponding use of the other features. Accordingly, it is appropriate that the appended claims be construed broadly and in a manner consistent with the scope of the invention.

What is claimed is:

1. In a tubular frame scaffolding system, an intermediate guard rail panel assembly comprising:

a first tubular truss having at least one pin mounted thereon;

a second tubular truss having at least upper and lower spaced apart pins mounted thereon;

an insert for detachable affixation to and between the first and second tubular trusses, said insert including:

a first bar having a U-shaped brace mounted thereon for receiving a portion of the first truss, the first bar further including an opening spaced from the brace for receiving the pin of the first truss;

a second bar including at least upper and lower slots for receiving the spaced apart pins of the second truss;

and a pair of spaced apart cross bars coupled to the first and second bars.

2. The intermediate guard rail panel assembly of claim 1, wherein the upper and lower slots are substantially T-shaped.

3. The intermediate guard rail panel assembly of claim 1, further comprising a third bar including an auxiliary upper slot for receiving the upper pin of the second truss, wherein the auxiliary slot and the upper slot are positioned in opposing relation.

4. The intermediate guard rail panel assembly of claim 1, further comprising a third bar including an auxiliary upper slot for receiving the upper pin of the second truss, wherein the auxiliary slot is substantially horizontal.

* * * * *